US012404137B2

(12) United States Patent
Morita

(10) Patent No.: US 12,404,137 B2
(45) Date of Patent: Sep. 2, 2025

(54) PAPER SHEET HANDLING APPARATUS

(71) Applicants: LAUREL BANK MACHINES CO., LTD., Tokyo (JP); LAUREL MACHINERY CO., LTD., Osaka (JP); LAUREL PRECISION MACHINES CO., LTD., Osaka (JP)

(72) Inventor: Tadaaki Morita, Tokyo (JP)

(73) Assignees: LAUREL BANK MACHINES CO., LTD., Tokyo (JP); LAUREL PRECISION CO., LTD., Osaka (JP)

( * ) Notice: Subject to any disclaimer, the term of this patent is extended or adjusted under 35 U.S.C. 154(b) by 165 days.

(21) Appl. No.: 18/256,166

(22) PCT Filed: Nov. 30, 2021

(86) PCT No.: PCT/JP2021/043994
§ 371 (c)(1),
(2) Date: Jun. 6, 2023

(87) PCT Pub. No.: WO2022/130970
PCT Pub. Date: Jun. 23, 2022

(65) Prior Publication Data

US 2024/0034589 A1 Feb. 1, 2024

(30) Foreign Application Priority Data

Dec. 16, 2020 (JP) ..... 2020-208350

(51) Int. Cl.
*B65H 31/34* (2006.01)

(52) U.S. Cl.
CPC ..... *B65H 31/34* (2013.01); *B65H 2405/10* (2013.01); *B65H 2701/1912* (2013.01)

(58) Field of Classification Search
CPC ..... B65H 31/38; B65H 31/34; B65H 31/36; B65H 2301/4462
See application file for complete search history.

(56) References Cited

U.S. PATENT DOCUMENTS 5,890,713 A * 4/1999 Hofmann ..... B65H 31/38 271/223

FOREIGN PATENT DOCUMENTS

JP 6128758 U 7/1984
JP 63-196457 A 8/1988
(Continued)

OTHER PUBLICATIONS

Supplementary European Search Report Mailed Oct. 23, 2024 in European Application No. 21906333.6, 17 pages.
(Continued)

*Primary Examiner* — Howard J Sanders
(74) *Attorney, Agent, or Firm* — Nixon & Vanderhye P.C.

(57) ABSTRACT

A paper sheet handling apparatus includes an accumulation and storage unit that accumulates and stores paper sheets conveyed by the conveyance unit while aligning the paper sheets, the accumulation and storage unit having an accumulation unit that accumulates the paper sheets so that a first direction which is one of a vertical width direction and a horizontal width direction and a second direction which is the other of the vertical width direction and the horizontal width direction are oriented in predetermined directions, a first alignment unit that is movable between a first retracted position spaced apart from the paper sheets and a first alignment position in contact with one end edge of the paper sheets positioned in the first direction; and a second alignment unit that is movable between a second retracted position spaced apart from the paper sheets and a second alignment position in contact with other end edge of the paper sheets positioned in the first direction, with a control unit that causes the paper sheets to be aligned in the first direction by causing the first alignment unit and the second alignment unit to move from the first retracted position and the second retracted position to the first alignment position
(Continued)

and the second alignment position and tap the paper sheets accumulated in the accumulation unit from both sides of the first direction.

6 Claims, 19 Drawing Sheets

(56) References Cited

FOREIGN PATENT DOCUMENTS

| | | | |
|---|---|---|---|
| JP | 1-242326 | A | 9/1989 |
| JP | 2-305771 | A | 12/1990 |
| JP | 6-71856 | A | 3/1994 |
| JP | H0912205 | A | 1/1997 |
| JP | H09194081 | A | 7/1997 |
| JP | 2002-29657 | A | 1/2002 |
| JP | 2010168150 | A | 8/2010 |
| JP | 5294897 | B2 | 9/2013 |
| JP | 2020070122 | A | 5/2020 |

OTHER PUBLICATIONS

International Search Report for PCT/JP2021/043994 mailed Feb. 8, 2022, 4 pages.
Notice of Reasons for Rejection mailed Apr. 2, 2024 in Japanese Application No. 2020-208350, with English translation, 9 pages.
Extended European Search Report mailed Feb. 11, 2025 in European Application No. 21906333.6, 16 pages.

* cited by examiner

PAPER SHEET HANDLING APPARATUS

TECHNICAL FIELD

The present invention relates to a paper sheet handling apparatus.

This application is the U.S. national phase of International Application No. PCT/JP2021/043994 filed Nov. 30, 2021, which designated the U.S. and claims priority to Japanese Patent Application No. 2020-208350 filed on Dec. 16, 2020, the entire contents of each of which are hereby incorporated herein by reference.

BACKGROUND ART

Conventionally, paper sheet handling apparatuses for handling paper sheets have been known (refer to Patent Document 1, for example).

The paper sheet handling apparatus is provided with a tapping mechanism that, by tapping paper sheets sent out from the paper sheet conveyance path, stores the paper sheets in an accumulated state in the accumulation and storage unit while aligning the paper sheets. The tapping mechanism has an elongated cylindrical tapping rod that can be horizontally rotated by a driving force such as a motor.

The tapping bar, by tapping the paper sheets sent out from the paper sheet conveyance path from one end edge side to the other end edge side located in the horizontal width direction of the paper sheets, can cause the other end edge of the paper sheets to abut against (contact) a fixed wall of the accumulation and storage unit. As a result, the paper sheets can be accumulated in the accumulation and storage unit while being aligned along the fixed wall.

PRIOR ART DOCUMENTS

Patent Document

[Patent Document 1]
Japanese Unexamined Patent Application, First Publication No. H09-12205

SUMMARY OF INVENTION

Problems to be Solved by the Invention

However, the paper sheet handling apparatus described in Patent Document 1 aligns the paper sheets by tapping the paper sheets only from one side (one end edge side in the horizontal width direction of the paper sheets) using the tapping bar. Therefore, in this paper sheet handling apparatus, the operation stroke (movement amount) until the paper sheets abut against the fixed wall of the accumulation and storage unit becomes large. Therefore, there is a disadvantage that considerable time is spent on the alignment work.

The present invention has been made in view of such circumstances. An example of an object of the present invention is to provide a paper sheet handling apparatus capable of aligning paper sheets quickly and reliably.

Means for Solving the Problems

A paper sheet handling apparatus according to a first aspect of the present invention includes a conveyance unit that conveys paper sheets, an accumulation and storage unit that accumulates and stores paper sheets conveyed by the conveyance unit while aligning the paper sheets, and a control unit that controls the accumulation and storage unit, wherein the accumulation and storage unit has: an accumulation unit that accumulates paper sheets so that a first direction, which is one direction of the vertical width direction and the horizontal width direction, and a second direction, which is the other of the vertical width direction and the horizontal width direction, are oriented in predetermined directions; a first alignment unit that is arranged more to one side in the first direction than the accumulation unit and constituted to be movable between a first retracted position spaced apart from the paper sheets accumulated in the accumulation unit, and a first alignment position that is in contact with one end edge positioned in the first direction of the paper sheets accumulated in the accumulation unit; a second alignment unit that is arranged more to the other side in the first direction than the accumulation unit and constituted to be movable between a second retracted position spaced apart from the paper sheets accumulated in the accumulation unit, and a second alignment position that is in contact with the other end edge positioned in the first direction of the paper sheets accumulated in the accumulation unit, and the control unit causes the paper sheets to be aligned in the first direction by causing the first alignment unit and the second alignment unit to move from the first retracted position and the second retracted position to the first alignment position and the second alignment position and tap the paper sheets accumulated in the accumulation unit from both sides in the first direction.

Advantageous Effects of the Invention

According to the present invention, it is possible to provide a paper sheet handling apparatus that quickly and reliably aligns paper sheets.

EMBODIMENTS FOR CARRYING OUT THE INVENTION

An embodiment of a paper sheet handling apparatus according to the present invention will be described below with reference to the drawings. In this embodiment, Japanese banknotes (1,000 yen note, 2,000 yen note, 5,000 yen note, and 10,000 yen note) will be described as examples of paper sheets. However, the paper sheets are not limited to this case, and foreign banknotes such as euro banknotes and dollar bills may be used.

Figure 1:
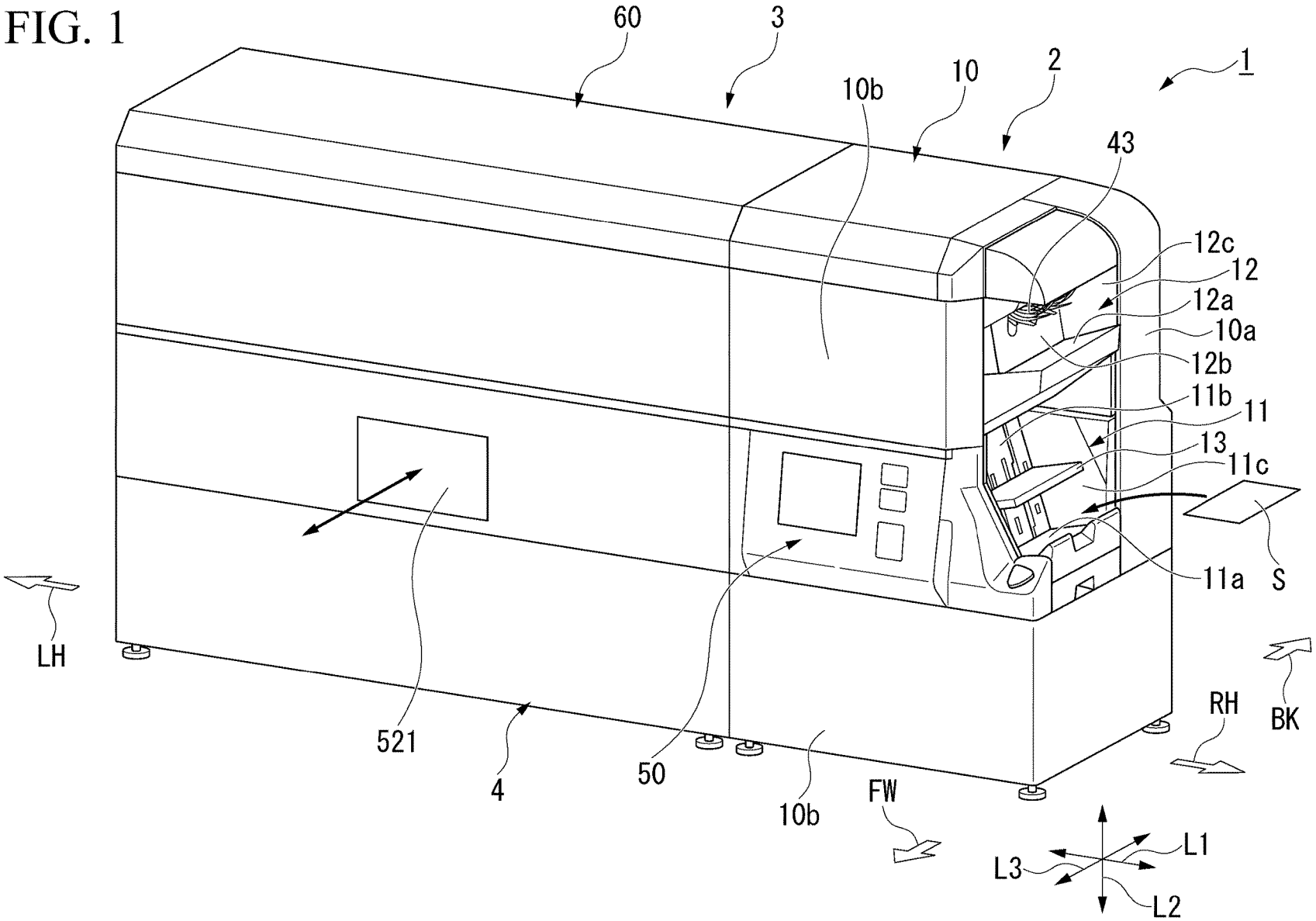
FIG. 1 is a perspective view showing the appearance of a banknote handling apparatus (paper sheet handling apparatus) according to an embodiment of the present invention.
Figure 2:
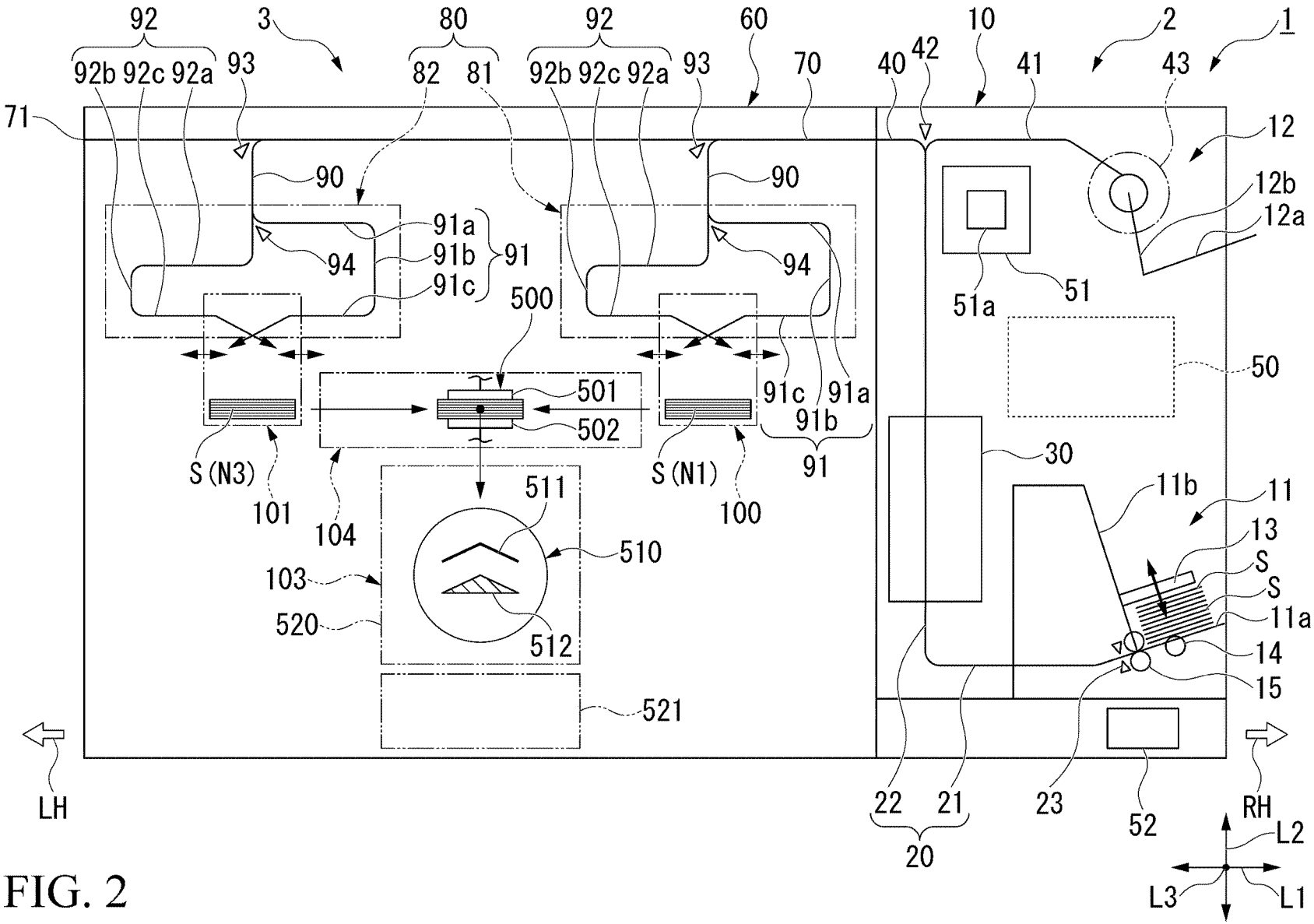
FIG. 2 is a side view showing the internal configuration of the banknote handling apparatus shown in FIG. 1.

As shown in FIGS. 1 and 2, a banknote handling apparatus (paper sheet handling apparatus according to an embodiment of the present invention) 1 of the present embodiment is provided with an identification and counting device 2, which is a first paper sheet handling apparatus, and an accumulation and bundling device 3, which is a second paper sheet handling apparatus. The identification and counting device 2 and the accumulation and bundling device 3 are connected side by side on a stand 4 provided on the floor, for example.

In the present embodiment, the direction in which the identification and counting device 2 and the accumulation and bundling device 3 are adjacent to each other is defined as the left-right direction L1. A direction perpendicular to the vertical direction L2 and the left-right direction L1 is defined as a front-rear direction L3. Further, of the front-rear direction L3, the direction from the banknote handling apparatus 1 toward the operator side is defined as front FW, and the opposite direction is defined as rear BK. Furthermore, left and right are defined from the viewpoint of the banknote handling apparatus 1 viewed from the operator side (front FW side). Therefore, when viewed from the operator side, the identification and counting device 2 side is the right side RH, and the accumulation and bundling device 3 side is the left side LH.

The identification and counting device 2 identifies and counts banknotes S input from the outside under predetermined conditions to perform classification processing, and conveys and delivers the banknotes S to the accumulation and bundling device 3. The accumulation and bundling device 3 performs front-back inversion of the banknotes S conveyed from the identification and counting device 2 based on the identification information of the banknotes S. As a result, the accumulation and bundling device 3 accumulates the banknotes S in the state of the front-back directionalities thereof being unified, and creates a plurality of small bundles.

The identification and counting device 2 and the accumulation and bundling device 3 will be described in detail below.

[Identification and Counting Device]

The identification and counting device 2 will be described in detail below.

As shown in FIGS. 1 and 2, the identification and counting device 2 performs a predetermined sorting process on banknotes S loaded from outside the device (externally) by an operator. Specifically, the identification and counting device 2 performs a classification process that identifies the banknotes S loaded from the outside of the machine and sorts the banknotes by denomination while counting them by denomination, a rejection process that rejects banknotes S other than those of the set denominations, and a front-back identification process that identifies the front and back faces of banknotes S of the set denominations. Note that the identification and counting device 2 is also called a base machine.

The identification and counting device 2 has a substantially rectangular device case 10. On the right side surface 10*a* of the device case 10, a loading unit 11 for loading banknotes S from outside the device (outside the device case 10) and a rejection unit 12 for receiving rejected banknotes S from inside the device (inside the device case 10) are formed.

The loading unit 11 and the rejection unit 12 are formed so as to continuously open from the right side surface 10*a* of the device case 10 to the front surface 10*b*. Note that the rejection unit 12 is arranged above the loading unit 11.

The identification and counting device 2 is further provided with an identification and conveyance unit 20, an identification unit 30, and an outbound conveyance unit 40. The identification and conveyance unit 20 conveys the banknotes S that have been loaded into the loading unit 11. The identification unit 30 identifies at least the front and back faces of the banknotes S being conveyed by the identification and conveyance unit 20. The outbound conveyance unit 40 receives the banknotes S whose front and back faces have been correctly identified by the identification unit 30 from the identification and conveyance unit 20 and conveys them toward the adjacent accumulation and bundling device 3.

The identification and conveyance unit 20, the identification unit 30 and the outbound conveyance unit 40 are provided inside the device case 10.

The identification and counting device 2 has an operation display unit 50, for example, of a touch panel type, that enables operation input by an operator and displays various kinds of information. The identification and counting device 2 is further provided with a control unit 51 and a power supply unit 52. The control unit 51 comprehensively controls the identification and counting device 2. The power supply unit 52 can be connected to an external power supply, and supplies power to each unit of the identification and counting device 2 and the accumulation and bundling device 3.

The operation display unit 50 is provided on the front surface 10*b* of the device case 10 and performs input/output of various signals, information, and the like with the control unit 51.

The control unit 51 is composed of a microcomputer on which a CPU or the like is mounted, for example, and includes a storage unit 51*a* such as a flash memory. The control unit 51 comprehensively controls not only the identification and counting device 2 but also the entire banknote handling apparatus 1 including the accumulation and bundling device 3. The storage unit 51*a* pre-stores, for example, a program or a table for causing the banknote handling apparatus 1 to execute various kinds of arithmetic processing. Furthermore, the storage unit 51*a* can store master data that serves as a reference for identification, data of identification and counting results, and the like.

The banknotes S are loaded into the loading unit 11 from the outside by the operator. At this time, the banknotes S are aligned in a predetermined direction and set on the bottom surface 11*a* of the loading unit 11 in a vertically accumulated state. Specifically, as shown in FIG. 1, the banknotes S are set on the bottom surface 11*a* of the loading unit 11 with the long sides of the banknotes S, that is, the width direction, aligned with the front-rear direction L3 of the device, and the short sides, that is, the lengthwise direction, of the banknotes S aligned with the left-right direction L1 of the device.

In particular, when the banknotes S are set in the loading unit 11, in relation to the front and back faces, they are set in a state in which four front and back patterns are mixed as shown in FIGS. 3 to 6.

Figure 3:
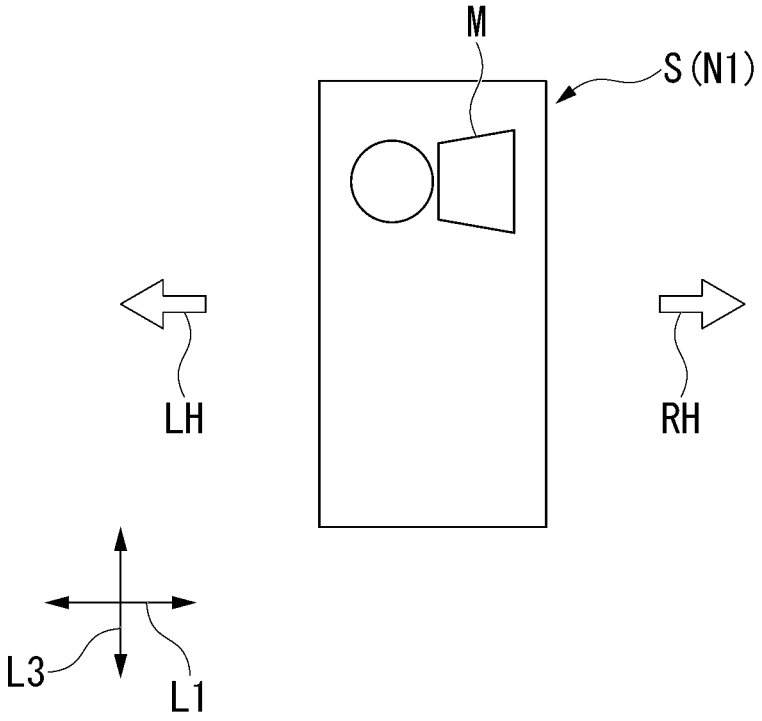
FIG. 3 is a plan view of a banknote showing one example of the front-back directionality pattern of a banknote handled by the banknote handling apparatus shown in FIG. 1.

As the first front-back pattern, as shown in FIG. 3, the surface on which a specific portrait M is clearly shown faces upward, and the portrait M faces the left side LH of the apparatus. In the present embodiment, this pattern is referred to as a banknote S in the first front orientation N1.

Figure 4:
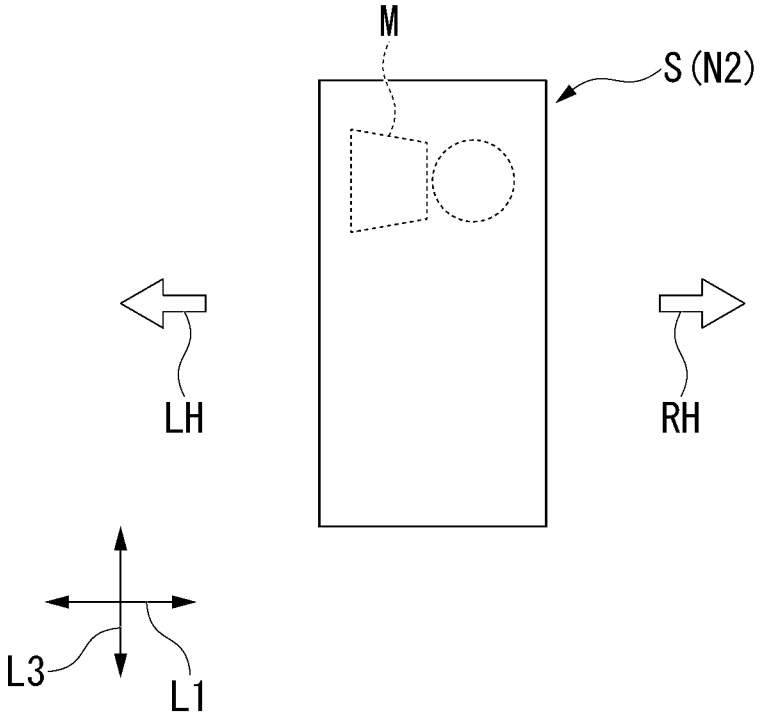
FIG. 4 is a plan view of a banknote showing another example of the front-back directionality pattern of a banknote handled by the banknote handling apparatus shown in FIG. 1.

As the second front-back pattern, as shown in FIG. 4, the surface on which a specific portrait M is clearly shown faces downward, and the portrait M faces the right side RH of the apparatus. In the present embodiment, this pattern is referred to as a banknote S in the first back orientation N2.

Figure 5:
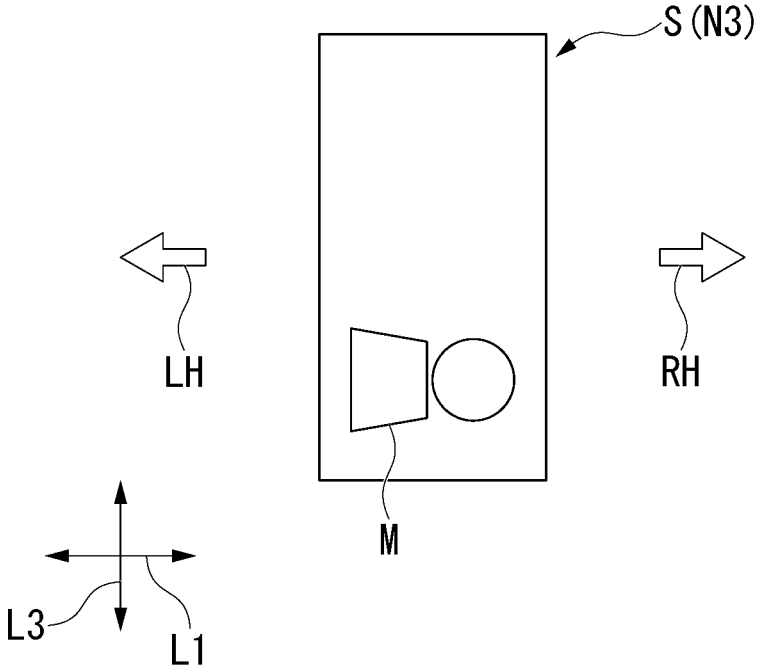
FIG. 5 is a plan view of a banknote showing yet another example of the front-back directionality pattern of a banknote handled by the banknote handling apparatus shown in FIG. 1.

As the third front-back pattern, as shown in FIG. 5, the surface on which a specific portrait M is clearly shown faces upward, and the portrait M faces the right side RH of the apparatus. In the present embodiment, this pattern is referred to as a banknote S in the second front orientation N3.

Figure 6:
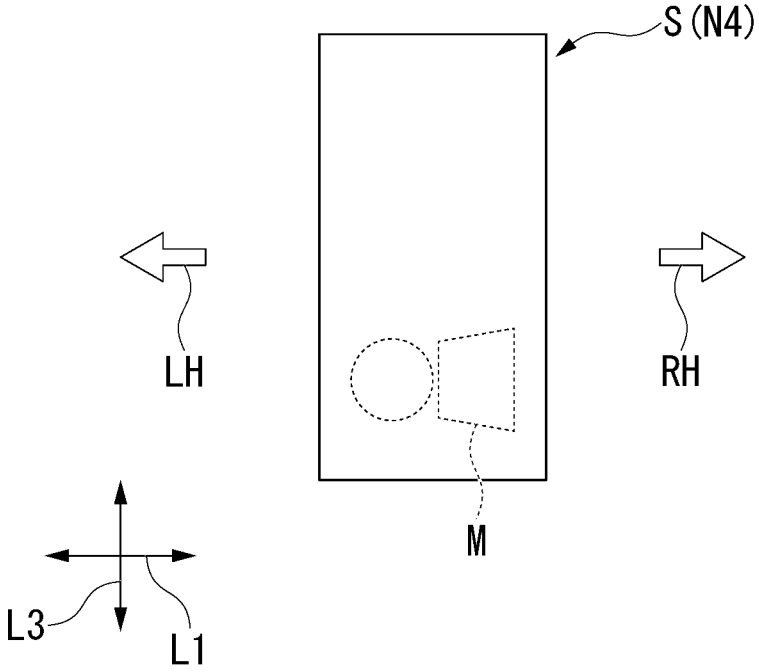
FIG. 6 is a plan view of a banknote showing still yet another example of the front-back directionality pattern of a banknote handled by the banknote handling apparatus shown in FIG. 1.

As the fourth front-back pattern, as shown in FIG. 6, the surface on which a specific portrait M is clearly shown faces downward, and the portrait M faces the left side LH of the apparatus. In the present embodiment, this pattern is referred to as a banknote S in the second back orientation N4.

In this way, the banknotes S are set in an accumulated state on the bottom surface 11*a* of the loading unit 11 shown in FIGS. 1 and 2 in the state of the above-described four front and back patterns being mixed. The loading unit 11 has a bottom surface 11*a*, a wall surface 11*b*, and a pair of side surfaces 11*c*. The bottom surface 11*a* is inclined slightly downward to the left with respect to the floor surface. The wall surface 11*b* extends upward from the left end of the bottom surface 11*a*. The pair of side surfaces 11*c* are integrally connected to the bottom surface 11*a* and the wall surface 11*b* and face each other in the front-rear direction L3.

A bill press 13 that moves up and down along the wall surface 11*b* is provided on the wall surface 11*b*. The bill press 13 presses down the banknotes S placed on the bottom surface 11*a* from above, and can hold the banknotes S stably by sandwiching the banknotes S with the bottom surface 11*a*.

As shown in FIG. 2, the loading unit 11 is provided with a feed-out roller 14 and a take-in roller 15. Out of the banknotes S set on the bottom surface 11*a*, the feed-out roller 14 feeds out the lowest banknote S one by one toward the left side LH of the apparatus. The take-in roller 15 takes in the banknotes S fed out by the feed-out roller 14 into the device and transfers the banknotes S to the identification and conveyance unit 20. Among the banknotes S set in the loading unit 11, only the lowest banknote S can be appropriately separated one by one by the feed-out roller 14 and the take-in roller 15 and transferred to the identification and conveyance unit 20.

The banknotes S transferred from the loading unit 11 to the identification and conveyance unit 20 thereafter move through the entire conveyance unit in the banknote handling apparatus 1 maintaining the orientation in which the short sides of the banknotes S, that is, the vertical width direction, are aligned with the left-right direction L1 or the vertical direction L2 of the apparatus. Therefore, the vertical width direction of the banknotes S coincides with the left-right direction L1 or vertical direction L2 of the apparatus, as well as with the direction of conveyance.

The identification and conveyance unit 20 is provided with a first identification and conveyance unit 21 extending from the loading unit 11 toward the left side LH. Moreover, the identification and conveyance unit 20 is provided with a second identification and conveyance unit 22 extending upward from the left end unit of the first identification and conveyance unit 21. Thereby, the banknotes S transferred from the loading unit 11 to the identification and conveyance unit 20 are conveyed toward the left side LH by the first identification and conveyance unit 21. Subsequently, the banknotes S are conveyed by the second identification and conveyance unit 22 with an upward orientation. Further, near the take-in roller 15 of the first identification and conveyance unit 21, a detection unit 23 is installed for detecting whether or not a banknote S has been taken in.

The outbound conveyance unit 40 is provided to extend from the upper end unit of the second identification and conveyance unit 22 toward the left side LH. The outbound conveyance unit 40 conveys the banknotes S toward a coupled conveyance unit 70 of the accumulation and bundling device 3, which will be described later. Moreover, a rejection conveyance unit 41 extending toward the right side RH is connected to the upper end unit of the second identification and conveyance unit 22. The rejection conveyance unit 41 is connected to the rejection unit 12. As a result, the outbound conveyance unit 40 and the rejection conveyance unit 41 are branched and connected to the upper end unit of the second identification and conveyance unit 22.

A sorting unit 42 is provided at the upper end of the second identification and conveyance unit 22. The sorting unit 42 sorts the banknotes S conveyed by the second identification and conveyance unit 22 to either the outbound conveyance unit 40 or the rejection conveyance unit 41. In other words, the sorting unit 42 plays a role of switching the conveyance destination of the banknotes S from the second identification and conveyance unit 22 to the outbound conveyance unit 40 or the rejection conveyance unit 41. The sorting unit 42 switches the conveyance destination of the banknotes S to the outbound conveyance unit 40 or the rejection conveyance unit 41 on the basis of the identification result of the identification unit 30.

The identification unit 30 is provided in the second identification and conveyance unit 22 and performs identification and counting of the banknotes S.

For example, the identification unit 30 identifies the type such as the denomination, and identifies the front-back pattern of each banknote S as one of the four front-back patterns described above (first front orientation N1, first back orientation N2, second front orientation N3, second back orientation N4).

Note that the identification unit 30 outputs the identification information (identification result) of the banknote S to the control unit 51.

Based on the identification information output from the identification unit 30, the control unit 51 determines whether the banknote S conveyed from the loading unit 11 can be accepted and whether it is of a preset denomination. When the conveyed banknote S is acceptable and is of a preset denomination, the control unit 51 has the banknote S conveyed from the second identification and conveyance unit 22 through the outbound conveyance unit 40 to the accumulation and bundling device 3.

Further, the control unit 51, upon determining that the banknote S conveyed from the loading unit 11 cannot be accepted based on the identification information output from the identification unit 30, determines the banknote S to be a banknote S to be rejected. In this case, the control unit 51 causes the banknote S to be conveyed from the second identification and conveyance unit 22 to the rejection unit 12 via the rejection conveyance unit 41.

Furthermore, upon determining, based on the identification information output from the identification unit 30, that the banknote S conveyed from the loading unit 11 is acceptable and has a denomination other than the preset denomination, for example, a 1,000-yen note different from the preset 10,000-yen note, the control unit 51 determines the conveyed banknote S to be a banknote S to be rejected. In this case, the control unit 51 causes the conveyed banknote S to be conveyed from the second identification and conveyance unit 22 to the rejection unit 12 via the rejection conveyance unit 41.

As shown in FIGS. 1 and 2, in the rejection unit 12, the banknotes S are fed out from the right end of the rejection conveyance unit 41, with the banknotes S being accumulated so as to be removable to the outside. In other words, the rejection unit 12 is an ejection port for ejecting banknotes S conveyed by the rejection conveyance unit 41 out of the machine.

The reject unit 12 has a bottom surface 12*a*, a wall surface 12*b*, and a pair of side surfaces 12*c*. The bottom surface 12*a* is inclined slightly downward to the left with respect to the floor surface. The wall surface 12*b* extends upward from the left end of the bottom surface 12*a*. The pair of side surfaces 12*c* are integrally connected to the bottom surface 12*a* and the wall surface 12*b* and face each other in the front-rear direction L3.

Further, the rejection unit 12 has an impeller 43 that causes the banknotes S fed out from the rejection conveyance unit 41 to fall toward the bottom surface 12*a* while being brought into contact with the wall surface 12*b*. Thereby, the rejection unit 12 can place the banknotes S fed out from the rejection conveyance unit 41 on the bottom surface 12*a* while stably accumulating them thereon.

[Accumulation and Bundling Device]

The accumulation and bundling device 3 will be described in detail below.

As shown in FIGS. 1 and 2, the accumulation and bundling device 3 is arranged on the left side LH of the identification and counting device 2 described above, and is equipped with a substantially rectangular device case 60. The device case 10 of the accumulation and bundling device 3 and the device case 60 of the identification and counting device 2 are integrally combined by a known method such as screw connection or pin connection.

However, the invention is not limited to the case where the separate device cases 10 and 60 are respectively provided. For example, the banknote handling apparatus 1 may have one common apparatus case, and the identification and counting device 2 and the accumulation and bundling device 3 may be arranged in this common apparatus case.

The accumulation and bundling device 3 performs front-back inversion of the banknotes S of a specific denomination conveyed by the outbound conveyance unit 40 of the identification and counting device 2 based on the identification information of the banknotes S. As a result, the front-back directionalities of the banknotes S are unified, and the banknotes S with the front-back directionalities thus unified are bundled to produce a small bundle.

As shown in FIG. 2, the accumulation and bundling device 3 has a coupled conveyance unit (conveyance unit according to the present invention) 70 that receives from the outbound conveyance unit 40 banknotes S whose front and back faces have been identified and conveys them. Further, the accumulation and bundling device 3 is provided with a front-back inverting unit 80 that inverts the banknotes S being conveyed by the coupled conveyance unit 70 based on the front-back identification information detected by the identification unit 30. The coupled conveyance unit 70 and the front-back inverting unit 80 are provided inside the device case 60.

(Coupled Conveyance Unit)

The coupled conveyance unit 70 is arranged on the upper surface side in the device case 60 and is arranged so as to linearly extend along the left-right direction L1. The coupled conveyance unit 70 conveys the banknotes S from the upstream right end to the downstream left end. The right end of the coupled conveyance unit 70 is connected to the outbound conveyance unit 40 of the identification and counting device 2. On the other hand, the left end of the coupled conveyance unit 70 opens to the left side surface of the device case 60, and for example can be used as an optional exit 71 that can be used for multiple purposes, such as conveying banknotes S to an evacuation pocket unit capable of storing banknotes that is installed on the left side surface of the device case 60 of the accumulation and bundling device 3.

As a result, the coupled conveyance unit 70 conveys the banknotes S received from the outbound conveyance unit 40 toward the left side LH. At this time, the banknotes S conveyed by the coupled conveyance unit 70 are a mixture of the above-described four front-back patterns. That is, banknotes in the first front orientation N1, banknotes in the first back orientation N2, banknotes in the second front orientation N3, and banknotes in the second back orientation N4 are conveyed by the coupled conveyance unit 70.

(Front-Back Inverting Unit)

Figure 7:
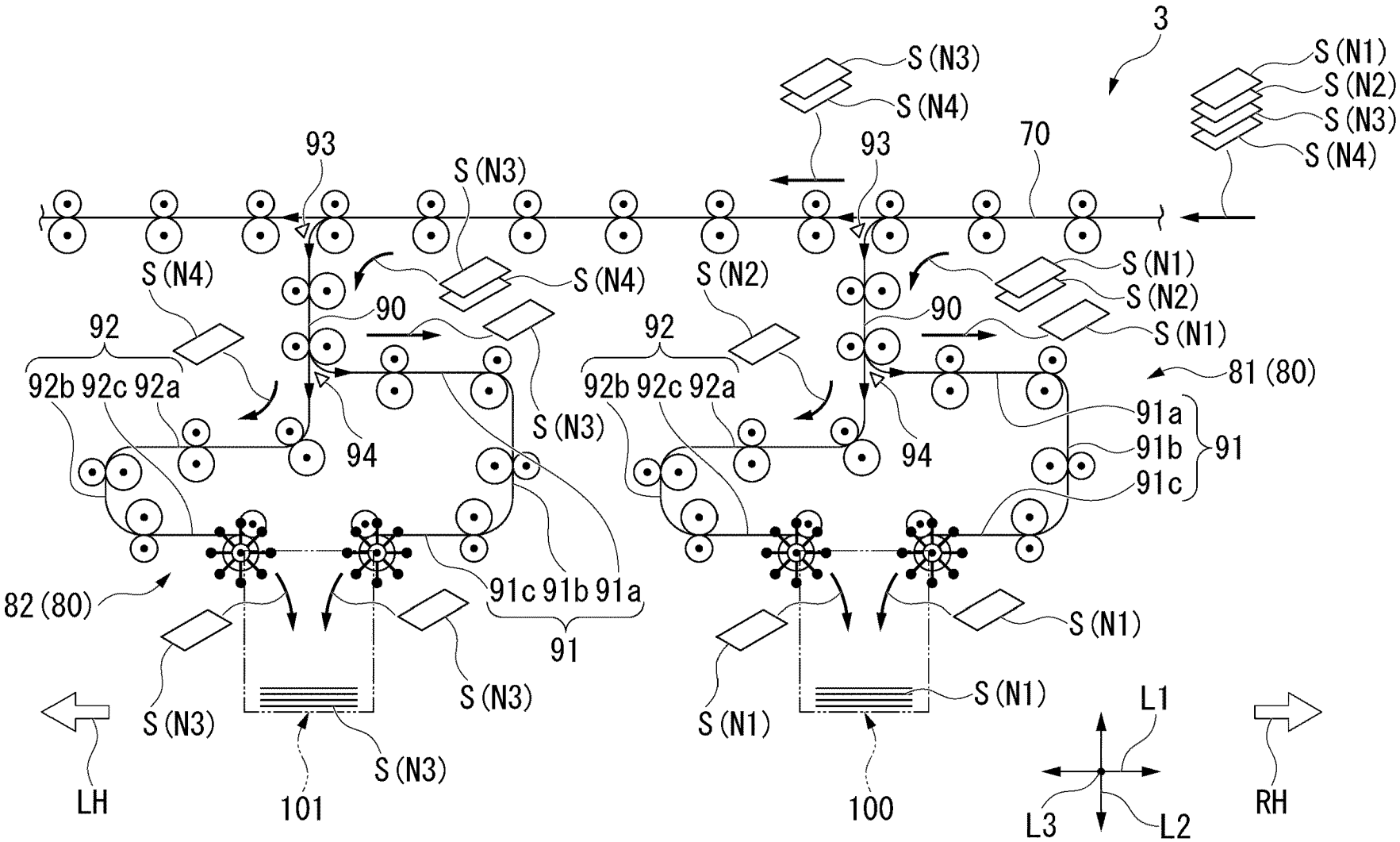
FIG. 7 is a configuration diagram showing a front-back inverting unit and peripheral mechanism units in the banknote handling apparatus shown in FIG. 2.

As shown in FIGS. 2 and 7, two front-back inverting units 80 are provided coupled to the coupled conveyance unit 70.

Specifically, the front-back inverting units 80 are arranged side by side in the left-right direction L1 and are provided at the same height position within the device case Therefore, the two front-back inverting units 80 are arranged adjacent to each other along the conveyance direction of the banknotes S conveyed by the coupled conveyance unit 70.

In the present embodiment, of the two front-back inverting units 80, the front-back inverting unit 80 on the right side RH positioned closer to the identification and counting device 2 is referred to as a first front-back inverting unit 81, and the front-back inverting unit 80 positioned on the left side LH is referred to as a second front-back inverting unit 82.

(First Front-Back Inverting Unit)

The first front-back inverting unit 81 is provided so as to intersect the coupled conveyance unit 70. The front-back inverting unit 81 is provided with a branching conveyance unit 90, a non-inverting unit 91, and an inverting unit 92. The branching conveyance unit 90 is coupled to the coupled conveyance unit 70. The non-inverting unit 91 inverts the banknotes S an even number of times based on the identification information detected by the identification unit 30, and so discharges the banknotes S with the same front-back directionality as before the front-back inversion. The non-inverting unit 92 inverts the banknotes S an odd number of times based on the identification information detected by the identification unit 30, and so discharges the banknotes S with a different front-back directionality than before the front-back inversion.

The branching conveyance unit 90 is arranged below the coupled conveyance unit 70 and is formed to extend in the vertical direction L2. The upper end unit of the branching conveyance unit 90 is connected to the coupled conveyance unit 70 from below so as to intersect the coupled conveyance unit 70 substantially at a right angle.

At the connection unit between the upper end unit of the branching conveyance unit 90 and the coupled conveyance unit 70 is provided a branch sorting unit 93 that sorts the banknotes S having two front-back patterns among the banknotes S conveyed from the coupled conveyance unit 70 to the branching conveyance unit 90, and flows the remaining banknotes S to the second front-back inverting unit 82 side positioned downstream of the branching conveyance unit 90.

Specifically, the branch sorting unit 93 sorts only the banknotes in the first front orientation N1 and the banknotes in the first back orientation N2 among the banknotes S conveyed by the coupled conveyance unit 70 to the branching conveyance unit 90. The branch sorting unit 93 passes the remaining banknotes S in the second front orientation N3 and banknotes S in the second back orientation N4, sorting them toward the second front-back inverting unit 82 side.

The operation of the branch sorting unit 93 is controlled by the control unit 51. Also, the control unit 51 controls the branch sorting unit 93 based on the identification information.

The non-inverting unit 91 is arranged below the coupled conveyance unit 70 and on the right side RH of the branching conveyance unit 90. In contrast, the inverting unit 92 is arranged below the coupled conveyance unit 70 and on the left side LH of the branching conveyance unit 90. Thereby, the non-inverting unit 91 and the inverting unit 92 are arranged side by side in the left-right direction L1 with the branching conveyance unit 90 interposed therebetween.

The non-inverting unit 91 is connected to the branching conveyance unit 90, and is formed to turn 180 degrees after heading from the branching conveyance unit 90 to the right end unit side that is the upstream side of the coupled conveyance unit 70, to head to the left end unit side that is the downstream side of the coupled conveyance unit 70.

Specifically, the non-inverting unit 91 includes a first non-inverting unit 91*a*, a second non-inverting unit 91*b*, and a third non-inverting unit 91*c*. The first non-inverting unit 91*a* is connected to a portion located between the upper end portion and the lower end portion of the branching conveyance unit 90 and extends toward the upstream side of the coupled conveyance unit 70 along the left-right direction L1. The second non-inverting unit 91*b* is connected to the right end side of the first non-inverting unit 91*a* and extends downward along the vertical direction L2. The third non-inverting unit 91*c* is connected to the lower end side of the second non-inverting unit 91*b* and extends toward the downstream side of the coupled conveyance unit 70 along the left-right direction L1. Thereby, the non-inverting unit 91 as a whole is formed in a U shape that bulges toward the upstream side of the coupled conveyance unit 70.

However, the overall shape of the non-inverting unit 91 is not limited to a U shape, and may be formed to bulge toward the upstream side of the coupled conveyance unit 70 in various curved shapes such as a semicircular shape, an arc shape, a C shape (katakana "ko" shape), or the like.

Since the non-inverting unit 91 is configured as described above, while the banknote S is being conveyed from the coupled conveyance unit 70 to the first non-inverting unit 91*a* of the non-inverting unit 91 via the branching conveyance unit 90, the banknote S can be front-back inverted once. Subsequently, while the banknote S is conveyed from the first non-inverting unit 91*a* to the third non-inverting unit 91*c* via the non-inverting unit 91*b*, the banknote S can be front-back inverted again.

As a result, the non-inverting unit 91 front-back inverts the banknote S twice (an even number of times) in total, and so can discharge the banknote S from the left end unit side of the third non-inverting unit 91*c* with the same front-back directionality as the banknote S when conveyed by the coupled conveyance unit 70.

The inverting unit 92 is connected to the branching conveyance unit 90, and is formed to turn 180 degrees after heading from the branching conveyance unit 90 to the left end portion side that is the downstream side of the coupled conveyance unit 70, to head to the right end portion side that is the upstream side of the coupled conveyance unit 70.

Specifically, the inverting unit 92 includes a first inverting unit 92*a*, a second inverting unit 92*b*, and a third inverting unit 92*c*. The first inverting unit 92*a* is connected to the lower end portion of the branching conveyance unit 90 and extends toward the downstream side of the coupled conveyance unit 70 along the left-right direction L1. The second inverting unit 92*b* is connected to the left end side of the first inverting unit 92*a* and extends downward along the vertical direction L2. The third inverting unit 92*c* is connected to the lower end side of the second inverting unit 92*b* and extends toward the upstream side of the coupled conveyance unit 70 along the left-right direction L1. Thereby, the inverting unit 92 as a whole is formed in a U shape that bulges toward the downstream side of the coupled conveyance unit 70.

However, the overall shape of the non-inverting unit 92 is not limited to a U shape, and may be formed to bulge toward the downstream side of the coupled conveyance unit 70 in various curved shapes such as a semicircular shape, an arc shape, a C shape (katakana "ko" shape), or the like.

Since the inverting unit 92 is configured as described above, while the banknote S is being conveyed from the coupled conveyance unit 70 to the first inverting unit 92*a* of the inverting unit 92 via the branching conveyance unit 90, the banknote S cannot be front-back inverted. After that, while the banknote S is being conveyed from the first inverting unit 92*a* to the third inverting unit 92*c* via the second inverting unit 92*b*, the banknote S can be front-back inverted once.

As a result, the non-inverting unit 92 front-back inverts the banknote S once (an odd number of times) in total, and so can discharge the banknote S from the right end portion side of the third inverting unit 92*c* with a different front-back directionality as the banknote S when conveyed by the coupled conveyance unit 70.

Note that the position of the left end of the third non-inverting unit 91*c* in the non-inverting unit 91 (discharge position of the banknote S) and the position of the right end of the third inverting unit 92*c* in the inverting unit 92 (discharge position of the banknote S) are positioned at the same height, and are arranged to face each other with a gap in the left-right direction L1.

In the present embodiment, since the non-inverting unit 91 is connected to a portion located between the upper end portion and the lower end portion of the branching conveyance unit 90, and the inverting unit 92 is connected to the lower end portion of the branching conveyance unit 90, the connection position between the branching conveyance unit 90 and the non-inverting unit 91 is located higher than the connection position between the branching conveyance unit 90 and the inverting unit 92.

However, the present invention is not limited to this case, and the connection position between the branching conveyance unit 90 and the inverting unit 92 may be positioned above the connection position between the branching conveyance unit 90 and the non-inverting unit 91.

At the connection unit between the branching conveyance unit 90 and the non-inverting unit 91, there is provided a gate unit 94 for switching the conveyance path so as to convey the banknotes S conveyed by the branching conveyance unit 90 to either the non-inverting unit 91 or the inverting unit 92.

The gate unit 94 performs sorting by switching the conveyance route so as to convey, among the banknotes S conveyed by the branching conveyance unit 90, the banknotes S in the first front orientation N1 to the non-inverting unit 91, and convey the remaining banknotes S in the first back orientation N2 to the inverting unit 92. The operation of the gate unit 94 is controlled by the control unit 51. Also, the control unit 51 controls the gate unit 94 based on the identification information.

As a result, among the banknotes S conveyed by the branching conveyance unit the first front-back inverting unit 81 causes the banknotes S in the first front orientation N1 to be discharged from the non-inverting unit 91 while maintaining the first front orientation N1 due to the two front-back inversions by the non-inverting unit 91. On the other hand, for the banknotes S in the first back orientation N2, the first front-back inverting unit 81 discharges the banknotes S from the inverting unit 92 in the state of the front-back directionality thereof being changed to the first front orientation N1 due to the one front-back inversion by the inverting unit 92.

Therefore, the first front-back inverting unit 81 can unify the front-back directionalities of the banknotes S discharged from the non-inverting unit 91 and the inverting unit 92 to the first front orientation N1.

(Second Front-Back Inverting Unit)

The second front-back inverting unit 82 is arranged on the left side LH of the first front-back inverting unit 81 and has the same configuration as the first front-back inverting unit 81. Accordingly, a detailed description of the second front-back inverting unit 82 will be omitted, with the main points that differ from the first front-back inverting unit 81 being described.

In addition, the same reference numerals are given to the same components of the second inverting unit 82 as the components constituting the first inverting unit 81.

The branch sorting unit 93 in the second inverting unit 82 sorts, among the banknotes conveyed by the coupled conveyance unit 70, the banknotes S that have passed through the branch sorting unit 93 in the first inverting unit 81, that is, the banknotes S in the second front orientation N3 and the banknotes S in the second back orientation N4, so as to flow to the second front-back inverting unit 82 side.

When the banknotes S other than the banknotes S in the second front orientation N3 and the banknotes S in the second back orientation N4 are conveyed by the coupled conveyance unit 70, the branch sorting unit 93 operates so as to allow these banknotes S to pass to flow toward the left end side, which is the downstream side of the coupled conveyance unit 70. As a result, even if banknotes S other than the banknotes S in the second front orientation N3 and the banknotes S in the second back orientation N4 have been conveyed to the second front-back inverting unit 82, these banknotes can be discharged from the option outlet 71 to the outside of the machine or to an evacuation pocket or the like.

The gate unit 94 in the second front-back inverting unit 82 performs sorting by switching the conveyance route so as to convey, among the banknotes S conveyed by the branching conveyance unit 90, the banknotes S in the second front orientation N3 to the non-inverting unit 91, and convey the remaining banknotes S in the second back orientation N4 to the inverting unit 92.

As a result, among the banknotes S conveyed by the branching conveyance unit 90, the second front-back inverting unit 82 causes the banknotes S in the second front orientation N3 to be discharged from the non-inverting unit 91 while maintaining the second front orientation N3 due to the two front-back inversions by the non-inverting unit 91. On the other hand, for the banknotes S in the second back orientation N4, the second front-back inverting unit 82 discharges the banknotes S from the inverting unit 92 in the state of the front-back directionality thereof being changed to the second front orientation N3 due to the one front-back inversion by the inverting unit 92.

Therefore, the second front-back inverting unit 82 can unify the front-back directionalities of the banknotes S discharged from the non-inverting unit 91 and the inverting unit 92 to the second front orientation N3.

As shown in FIGS. 2 and 7, the accumulation and bundling device 3 of the present embodiment further includes a first accumulation and storage unit 100, a second accumulation and storage unit 101, a bundling unit 103, and an accumulation conveyance unit 104. The first accumulation and storage unit 100 accumulates and stores the banknotes S inverted by the first front-back inverting unit 81. The second accumulation and storage unit 101 accumulates and stores the banknotes S inverted by the second front-back inverting unit 82. The bundling unit 103 binds the accumulated banknotes S into a small bundle. The accumulation conveyance unit 104 conveys the banknotes S stored in the first accumulation and storage unit 100 and the banknotes S stored in the second accumulation and storage unit 101 to the bundling unit 103 while maintaining the accumulation state.

The first accumulation and storage unit 100, the second accumulation and storage unit 101, the bundling unit 103, and the accumulation conveyance unit 104 are provided in the device case 60 so as to be positioned below the first and second inverting units 81 and 82.

(First Accumulation and Storage Unit)

The first accumulation and storage unit 100 is positioned below the branching conveyance unit 90 in the first inverting unit 81 and between the left end of the third non-inverting unit 91*c* and the right end of the third inverting unit 92*c*. Thereby, the banknotes S in the first front orientation N1 that are discharged from the third non-inverting unit 91*c* after two front-back inversions by the non-inverting unit 91 are loaded one by one into the first accumulation and storage unit 100. Moreover, the banknotes S in the first front orientation N1 that are discharged from the third inverting unit 92*c* after one front-back inversion by the inverting unit 92 are loaded one by one into the first accumulation and storage unit 100.

Accordingly, the banknotes S unified in the first front orientation N1 from the non-inverting unit 91 and the inverting unit 92 are continuously and alternately loaded into the first accumulation and storage unit 100, for example. Therefore, the banknotes S in the first front orientation N1 can be stored in an accumulated state the first accumulation and storage unit 100, and the banknotes S can be grouped by a predetermined number (for example, 100).

In particular, a predetermined number of the banknotes S can be accumulated in the first accumulation and storage unit 100 in a state of being aligned in the horizontal width direction and the vertical width direction of the banknotes S. At this time, as described above, the banknotes S can be accumulated in a state of the horizontal width direction of the banknotes S being made to match the front-rear direction L3 of the apparatus, and the vertical width direction of the banknotes S being made to match the left-right direction L1 of the apparatus.

The first accumulation and storage unit 100 will be described in detail below.

Figure 8:
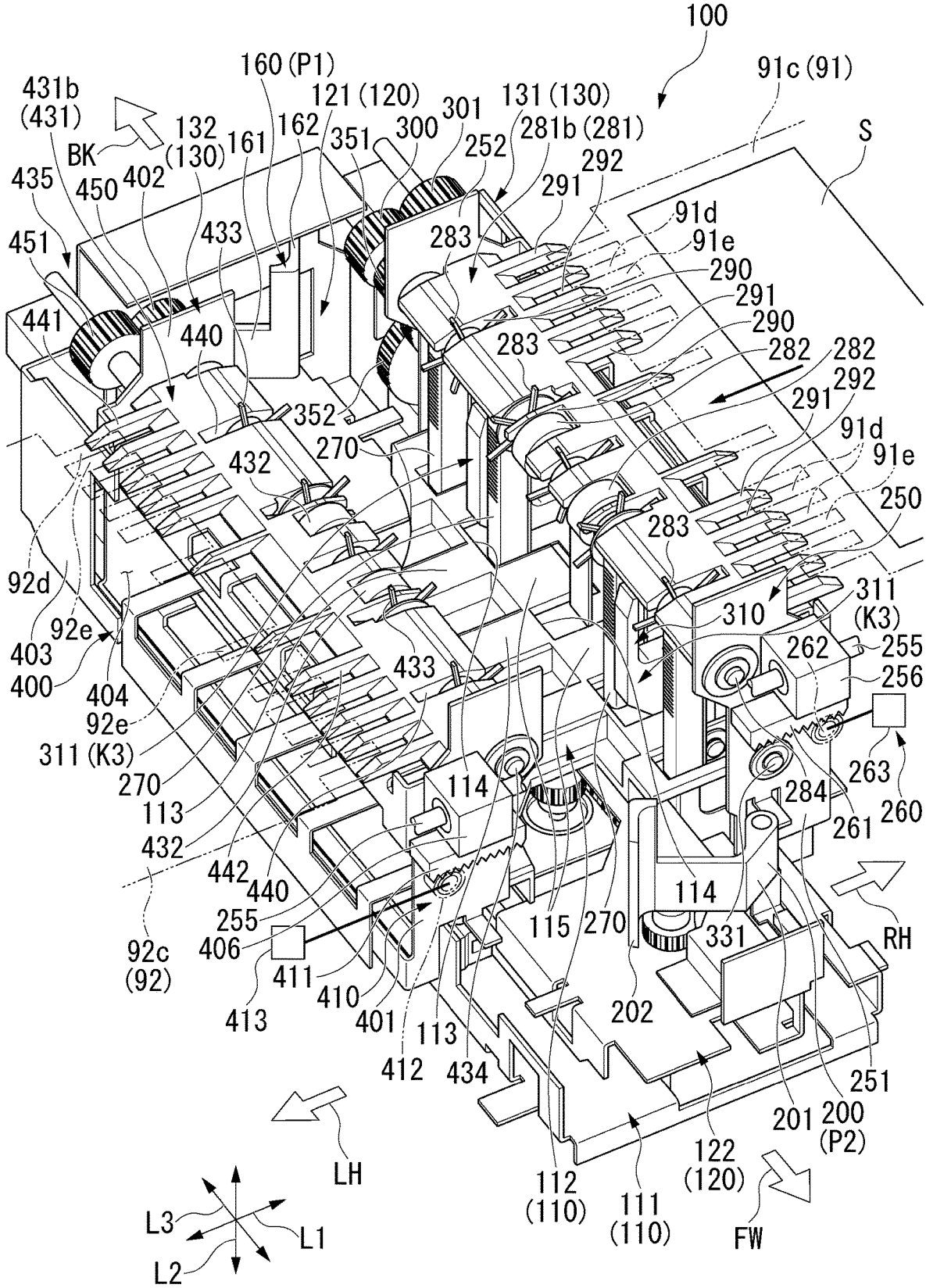
FIG. 8 is a perspective view showing a first accumulation and storage unit of the banknote handling apparatus shown in FIG. 2.

As shown in FIG. 8, the accumulation and storage unit 100 is provided with a unit base unit (accumulation unit according to the present invention) that accumulates the banknotes S so that a first direction, which is one direction of the vertical width direction and the horizontal width direction of the banknotes S, and a second direction, which is the other direction, face in predetermined directions. In the present embodiment, the unit base unit 110 accumulates the banknotes S so that the horizontal width direction of the banknotes S faces the front-rear direction L3 of the apparatus, and the vertical width direction of the banknotes S faces the left-right direction L1 of the device (that is, the conveyance direction).

Furthermore, the first accumulation and storage unit 100 is provided with a width-direction alignment unit 120 that aligns the banknotes S accumulated in the unit base unit 110 in the horizontal width direction, and a conveyance direction alignment unit 130 that aligns the banknotes S accumulated in the unit base unit 110 in the conveyance direction.

(First Accumulation and Storage Unit: Unit Base Unit)

Figure 9:
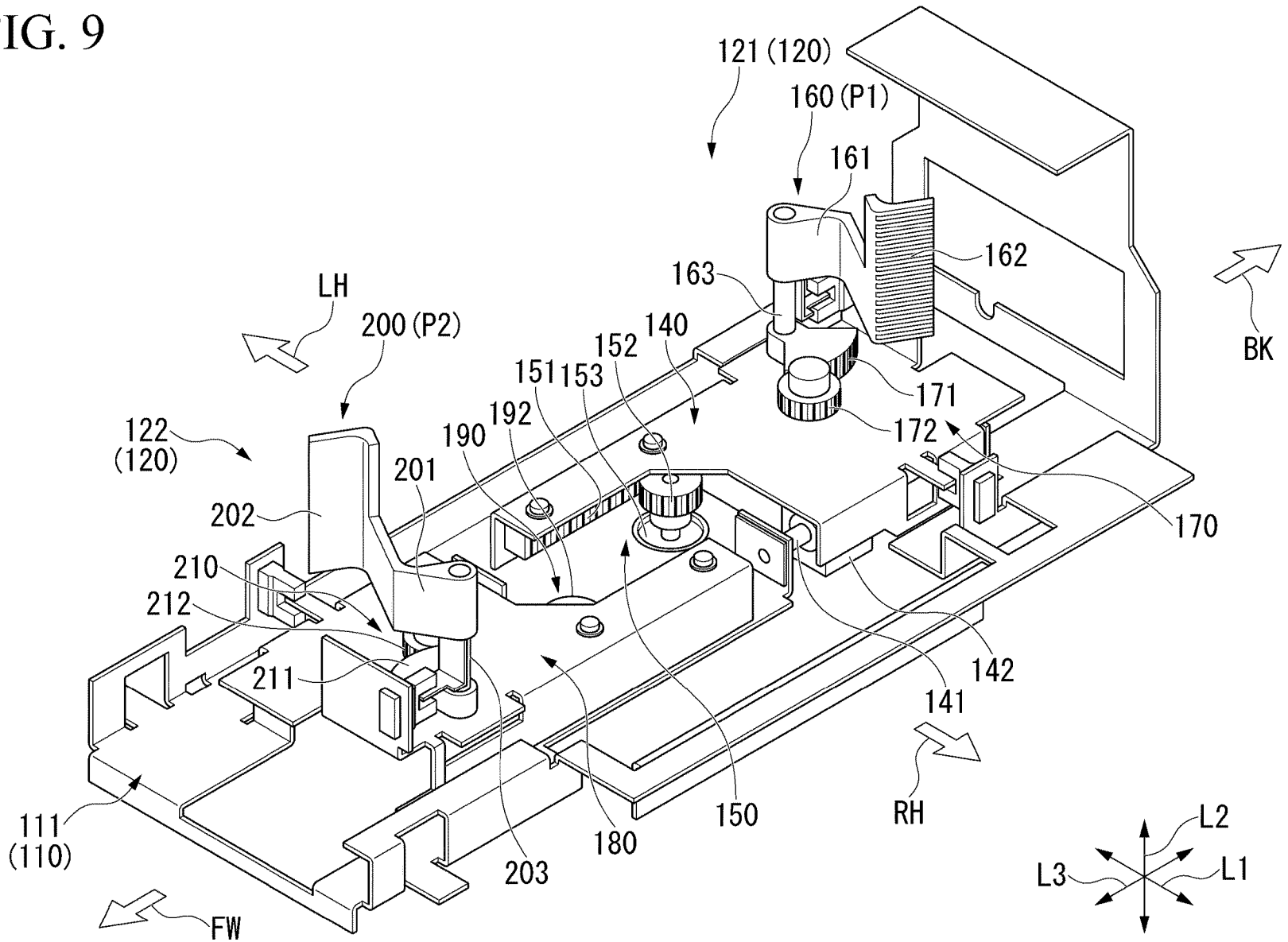
FIG. 9 is a perspective view showing a width-direction alignment unit of the first accumulation and storage unit shown in FIG. 8.

As shown in FIGS. 8 and 9, the unit base unit 110 is provided with a lower base unit 111 and an upper base unit 112 arranged above the lower base unit 111 with a space therebetween. The lower base unit 111 and the upper base unit 112 are fixed with the space therebetween in the vertical direction L2 by a supporting member or the like (not shown).

The lower base unit 111 is made of, for example, a thin metal plate, and has a rectangular outer shape in plan view that is longer in the front-rear direction L3 than in the left-right direction L1. Note that the lower base unit 111 is formed by bending the metal plate.

Like the lower base unit 111, the upper base unit 112 is made of, for example, a thin metal plate, and has a rectangular outer shape in plan view that is longer in the front-rear direction L3 than in the left-right direction L1. However, the upper base unit 112 is formed to have a smaller outer shape than the lower base unit 111. Further, the upper base unit 112 is formed by bending a metal plate, and is appropriately formed with hollowed recesses and the like.

As shown in FIG. 8, in the upper surface of the upper base unit 112, the central area positioned at the center in the left-right direction L1 is used as a main accumulation area 113 where banknotes S discharged from the non-inverting unit 91 and the inverting unit 92 are accumulated. Therefore, it is possible to accumulate banknotes S on the upper base unit 112 using the main accumulation area 113.

At both ends of the upper base unit 112 in the left-right direction L1, there are formed a plurality of expansion accommodation holes 114 that pass through the upper base unit 112 in the vertical direction L2 and open on both sides in the left-right direction L1. The plurality of expansion accommodation holes 114 are formed so as to be spaced apart in the front-rear direction L3.

The conveyance direction alignment unit 130 is accommodated in the plurality of expansion accommodation holes 114 so as to be relatively movable in the left-right direction L1 with respect to the upper base unit 112.

Specifically, a third stopper unit 270, an alignment plate 311 and the like of a third alignment mechanism 131, to be described later, are mainly accommodated to be movable in the left-right direction L1 in the plurality of expansion accommodation holes 114 formed in the right side RH of the upper base unit 112. A fourth stopper unit 420 of a fourth alignment mechanism 132, which will be described later, is accommodated so as to be movable in the left-right direction L1 in a plurality of expansion accommodation holes (not shown) formed in the left side LH of the upper base unit 112.

These will be explained later.

The area on the top surface of the upper base 112 that is located on both sides of the main accumulation area 113 in the left-right direction L1 and between adjacent expansion accommodation holes 114 in the front-rear direction L3 is used as an expansion accumulation area 115.

The expansion accumulation area 115 is used as an additional area in which banknotes S can be accumulated in addition to the main accumulation area 113 when the third alignment mechanism 131 and the fourth alignment mechanism 132 are moved away from each other in the left-right direction L1. Note that the expansion accumulation area 115 can accumulate the banknotes S even if the third alignment mechanism 131 and the fourth alignment mechanism 132 are spaced apart to the maximum extent in the left-right direction L1.

(First Accumulation and Storage Unit: Width-Direction Alignment Unit)

Figure 10:
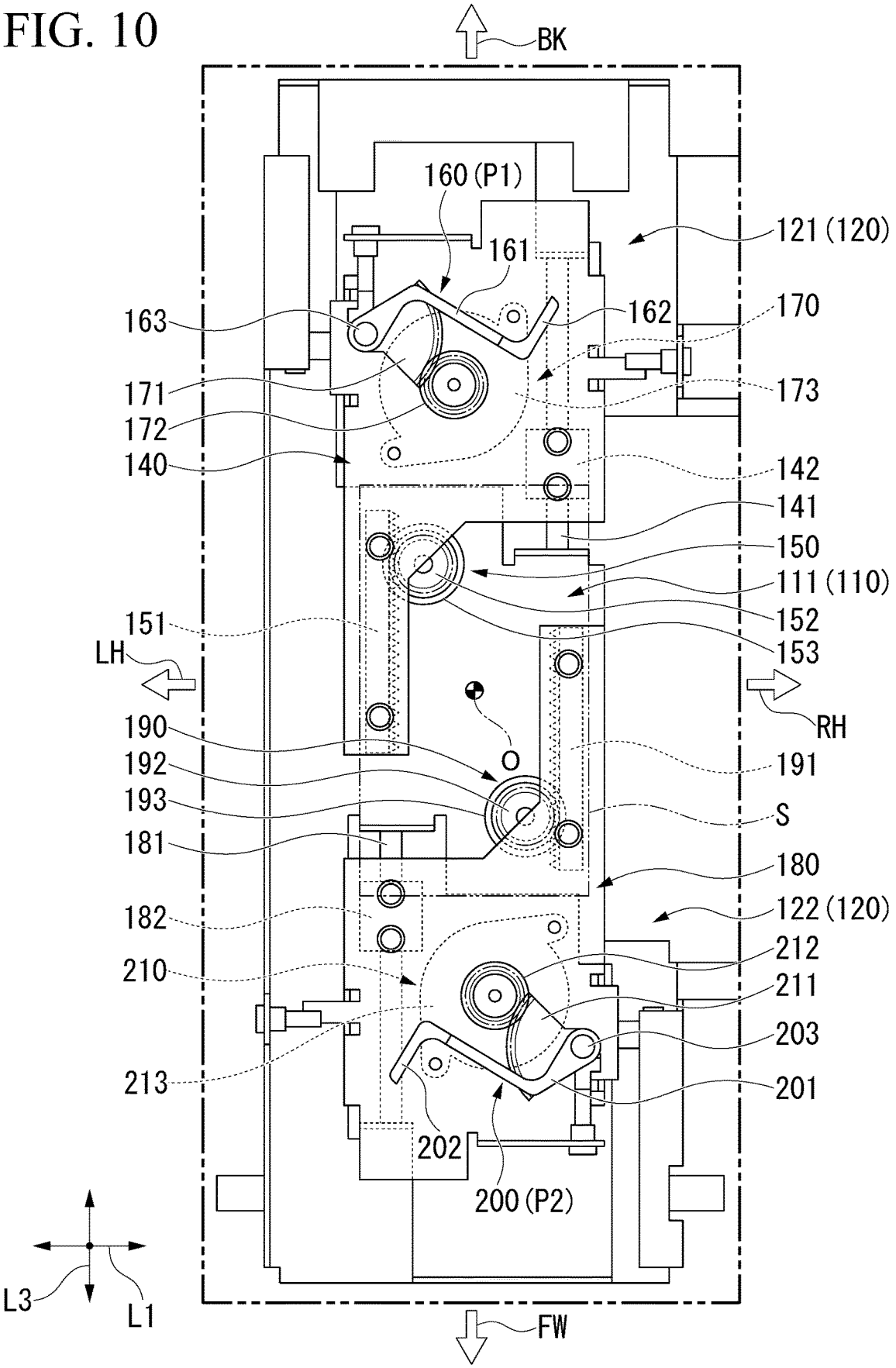
FIG. 10 is a plan view showing the width-direction alignment unit shown in FIG. 9.

As shown in FIGS. 8 to 10, the width-direction alignment unit 120 is provided with a first alignment mechanism 121 and a second alignment mechanism 122 arranged to face each other in the front-rear direction L3 with the upper base unit 112 interposed therebetween, and uses the main accumulation area 113 to align banknotes S accumulated on the upper base unit 112 in the horizontal width direction.

The first alignment mechanism 121 is located more to the rear BK side of the apparatus than the upper base unit 112 and is provided so as to be movable relative to the upper base unit 112 in the front-rear direction L3. In contrast, the second alignment mechanism 122 is located more to the front FW side of the apparatus than the upper base unit 112 and is provided so as to be movable relative to the upper base unit 112 in the front-rear direction L3.

(Width-Direction Alignment Unit: First Alignment Mechanism)

The first alignment mechanism 121 will be described in detail.

The first alignment mechanism 121 is provided with a first base unit 140, a first base drive unit 150, a first alignment unit 160, and a first alignment drive unit 170. The first base unit 140 is movable in the front-rear direction L3 with respect to the upper base unit 112. The first alignment unit 160 is provided in the first base unit 140. The first base drive unit 150 drives the first base unit 140. The first alignment drive unit 170 drives the first alignment unit 160.

The first base unit 140 is made of, for example, a thin metal plate. The first base unit 140 is arranged between the lower base unit 111 and the upper base unit 112 and is arranged on the rear BK side of the upper base unit 112.

On the underside of the first base unit 140, a first guide shaft 141 fixed to the lower base unit 111 is inserted inside, and a first linear motion guide unit 142 is provided to linearly guide the first guide shaft 141.

The first guide shaft 141 is a cylindrical rod arranged on the right side RH of the lower base unit 111 and linearly extending along the front-rear direction L3. The first linear motion guide unit 142 is a guide member such as a linear ball bearing, for example. The first linear motion guide unit 142 is arranged on the right side RH of the first base unit 140, and the first guide shaft 141 is slidably fitted therein. Thereby, the first base unit 140 is supported so as to be movable along the front-rear direction L3 with high-precision straightness while being guided by the first guide shaft 141.

The first base drive unit 150 is provided with a first rack gear 151, a first pinion gear 152, and a first base drive motor 153. The first rack gear 151 is fixed to the bottom surface of the first base unit 140. The first pinion gear 152 is provided in the first base unit 140 side and meshes with the first rack gear 151. The first base drive motor 153 drives the first pinion gear 152.

The first rack gear 151 is formed in a straight line extending along the front-rear direction L3. The first rack gear 151 is arranged on the left side LH of the first base unit 140 and fixed to the lower surface of the first base unit 140 with the rack teeth directed to the right side RH. The first base drive motor 153 is fixed to the lower surface side of the lower base unit 111, with the drive shaft thereof protruding to the upper surface side of the lower base. The first pinion gear 152 is attached to the drive shaft of the first base drive motor 153.

The first base drive motor 153 is, for example, a stepping motor, and its operation is controlled by the control unit 51, and rotates the first pinion gear 152 forward and backward based on signals from the control unit 51. Thereby, the first base unit 140 can be moved in the front-rear direction L3 while being guided by the first guide shaft 141 via the first rack gear 151.

In this way, since the first base unit 140 can be moved in the front-rear direction L3, by moving the first base unit 140 according to the size (horizontal width) of the banknotes S, banknotes S of various sizes can be handled.

The first alignment unit 160 has a first arm unit 161 and a first plane contact unit 162, and is formed in a Z shape (crank shape) in plan view. The first alignment unit 160 is arranged on the upper surface side of the first base unit 140. Also, the first alignment unit 160 is arranged so as to be positioned above the upper base unit 112 of the unit base unit 110. The first arm unit 161 is attached to a first alignment shaft 163 rotatably erected on the upper surface of the first base unit 140. Accordingly, the first alignment unit 160 is rotatable around the first alignment shaft 163. The first alignment shaft 163 is arranged so as to be positioned on the rear BK side of the first rack gear 151.

Figure 11:
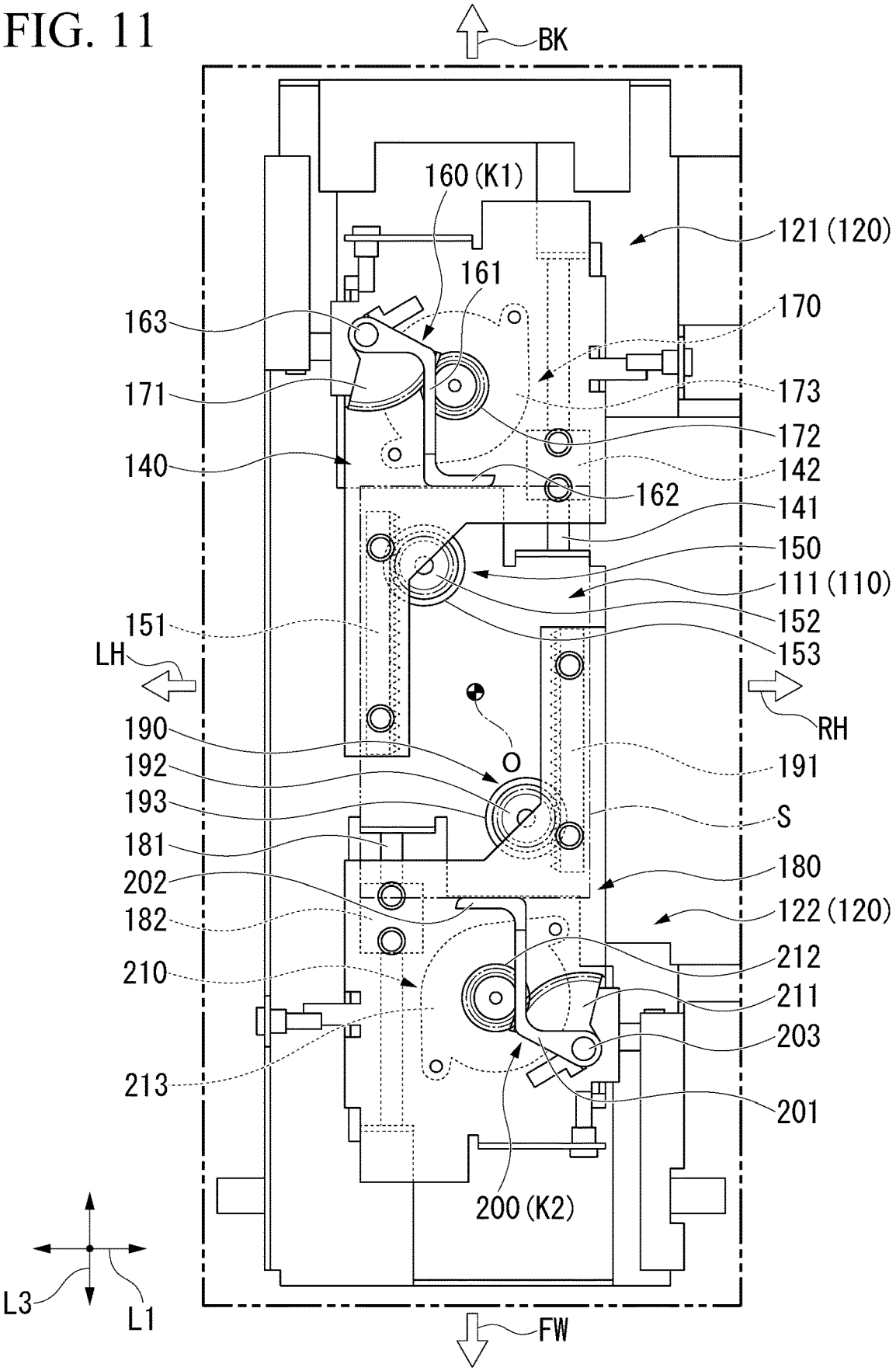
FIG. 11 is a plan view showing a state in which the first alignment unit and the second alignment unit of the width-direction alignment unit shown in FIG. 10 are positioned at the first alignment position and the second alignment position.

The first alignment unit 160 is rotatable (movable) about the first alignment shaft 163 between a first retracted position P1 as shown in FIG. 10 and a first alignment position K1 as shown in FIG. 11. As shown in FIG. 10, the first retracted position P1 is a position where a first planar contact unit 162 of the first alignment unit 160 is located more toward the rear BK side than an entry area of the banknotes S through which the banknotes S discharged from the non-inverting unit 91 and the inverting unit 92 pass until being accumulated on the upper base unit 112, with the first planar contact unit 162 being separated to the rear BK side from the banknotes S accumulated on the upper base unit 112. As shown in FIG. 11, the first alignment position K1 is a position where the first planar contact unit 162 of the first alignment unit 160 contacts one edge in the horizontal width direction of the banknotes S accumulated on the upper base unit 112.

As shown in FIGS. 9 and 10, the first planar contact unit 162 is provided at the tip of the first arm unit 161. The first planar contact unit 162 is wider than the first arm unit 161 and formed in a flat planar shape. The first planar contact unit 162 is formed so that the lower end thereof is positioned at the same height as the upper surface of the upper base unit 112 and the upper end is located above the height of all the banknotes S when a predetermined number (for example, 100) of banknotes S are accumulated on the upper base unit 112.

In particular, when the first alignment unit 160 is positioned at the first alignment position K1, the first planar contact unit 162 is provided so as to be substantially parallel along the vertical width direction (conveyance direction) of the banknotes S, as shown in FIG. 11. Thereby, the first planar contact unit 162 can come into, for example, linear contact or surface contact with one edge in the horizontal width direction of the banknotes S.

In addition, since the first base unit 140 can be moved according to the horizontal width size of the banknotes S accumulated on the upper base unit 112, the rotation angle of the first alignment unit 160 around the first alignment shaft 163 can be made constant regardless of the horizontal width size of the banknotes S to be accumulated.

As shown in FIGS. 9 and 10, the first alignment drive unit 170 is provided with a first alignment gear 171, a first motor gear 172, and a first alignment drive motor 173. The first alignment gear 171 is provided integrally with the first alignment shaft 163. The first motor gear 172 meshes with the first alignment gear 171. The first alignment drive motor 173 drives the first motor gear 172.

The first alignment gear 171 is formed in a fan shape in a plan view with the teeth facing the right side RH, and is arranged on the upper surface side of the first base unit 140. The first alignment drive motor 173 is fixed to the lower surface side of the first base unit 140, with the drive shaft thereof protruding to the upper surface side of the first base unit 140. The first motor gear 172 is attached to the drive shaft of the first alignment drive motor 173.

The first alignment drive motor 173 is, for example, a stepping motor. The operation of the first alignment drive motor 173 is controlled by the control unit 51, with the first alignment gear 171 being driven forward and backward on the basis of a signal from the control unit 51. Accordingly, the first alignment drive motor 173 can rotate the first alignment shaft 163 via the first alignment gear 171, and thereby can move the first alignment unit 160 back and forth between the first retracted position P1 and the first alignment position K1.

(Width-Direction Alignment Unit: Second Alignment Mechanism)

The second alignment mechanism 122 is arranged more on the front FW side of the apparatus than the upper base unit 112. The second alignment mechanism 122 is arranged to face the above-described first alignment mechanism 121 in the front-rear direction L3 with the upper base unit 112 interposed therebetween. The second alignment mechanism 122 of this embodiment has the same configuration as the first alignment mechanism 121. The second alignment mechanism 122 is arranged to be point symmetrical to the first alignment mechanism 121, rotated 180 degrees, with the reference position O (see FIG. 10) of the upper base unit 112, that is, the center of the front-rear direction L3 and the left-right direction L1, as a base point.

Accordingly, with respect to the second alignment mechanism 122, the same components as those of the first alignment mechanism 121 are given "second" instead of "first" in their names, and will be briefly described below.

The second alignment mechanism 122 is provided with a second base unit 180, a second base drive unit 190, a second alignment unit 200, and a second alignment drive unit 210. The second base unit 180 is movable in the front-rear direction L3 with respect to the upper base unit 112. The second base drive unit 190 drives the second base unit 180. The second alignment unit 200 is provided on the second base unit 180. The second alignment drive unit 210 drives the second alignment unit 200.

The second base unit 180 is arranged on the front FW side of the upper base unit 112. A second linear guide unit 182 that guides a second guide shaft 181 fixed to the lower base unit 111 is provided on the lower surface of the second base unit 180. The second guide shaft 181 is arranged on the left side LH of the lower base unit 111, and the second linear guide unit 182 is arranged on the left side LH of the second base unit 180. Thereby, the second base unit 180 is supported so as to be movable along the front-rear direction L3 with high-precision straightness while being guided by the second guide shaft 181.

The second base drive unit 190 is provided with a second rack gear 191, a second pinion gear 192, and a second base drive motor 193. The second rack gear 191 is fixed to the bottom surface of the second base unit 180. The second pinion gear 192 is provided in the second base unit 180 and meshes with the second rack gear 191. The second base drive motor 193 drives the second pinion gear 192.

The second rack gear 191 is arranged on the right side RH of the second base unit 180. The second pinion gear 192 is attached to the drive shaft of the second base drive motor 193. The second base drive motor 193 rotates the second pinion gear 192 forward and backward based on a signal from the control unit 51. Thereby, the second base unit 180 can be moved in the front-rear direction L3 while being guided by the second guide shaft 181 via the second rack gear 191.

The second alignment unit 200 has a second arm unit 201 and a second planar contact unit 202 and is arranged on the upper surface side of the second base unit 180. Also, the second alignment unit 200 is arranged so as to be positioned above the upper base unit 112 of the unit base unit 110. The second arm unit 201 is attached to a second alignment shaft 203 rotatably erected on the upper surface of the second base unit 180. Accordingly, the second alignment unit 200 is rotatable around the second alignment shaft 203. The second alignment shaft 203 is arranged so as to be positioned on the front FW side of the second rack gear 191.

The second alignment unit 200 is rotatable (movable) about the second alignment shaft 203 between a second retracted position P2 as shown in FIG. 10 and a second alignment position K2 as shown in FIG. 11. As shown in FIG. 10, the second retracted position P2 is a position where the second planar contact unit 202 of the second alignment unit 200 is located more toward the front FW side than an entry area of the banknotes S through which the banknotes S discharged from the non-inverting unit 91 and the inverting unit 92 pass until being accumulated on the upper base unit 112, with the second planar contact unit 202 being separated to the front FW side from the banknotes S accumulated on the upper base unit 112. As shown in FIG. 11, the second alignment position K2 is a position where the second planar contact unit 202 of the second alignment unit 200 contacts the other edge in the horizontal width direction of the banknotes S accumulated on the upper base unit 112.

As shown in FIGS. 9 and 10, the second planar contact unit 202 is provided at the tip of the second arm unit 201. The second planar contact unit 202 is formed so that the lower end thereof is positioned at the same height as the upper surface of the upper base unit 112 and the upper end is located above the height of all the banknotes S when a predetermined number (for example, 100) of banknotes S are accumulated on the upper base unit 112.

In particular, when the second alignment unit 200 is positioned at the second alignment position K2, the second planar contact unit 202 is provided so as to be substantially parallel along the vertical width direction (conveyance direction) of the banknotes S, as shown in FIG. 11. Thereby, the second planar contact unit 202 can come into, for example, linear contact or surface contact with the other edge in the horizontal width direction of the banknotes S.

As shown in FIGS. 9 and 10, the second alignment drive unit 210 is provided with a second alignment gear 211, a second motor gear 212, and a second alignment drive motor 213. The second alignment gear 211 is provided integrally with the second alignment shaft 203. The second motor gear 212 meshes with the second alignment gear 211. The second alignment drive motor 213 drives the second motor gear 212.

The second alignment gear 211 is formed in a fan shape in a plan view with the teeth facing the left side LH, and is arranged on the upper surface side of the second base unit 180. The second motor gear 212 is attached to the drive shaft of the second alignment drive motor 213.

The second alignment drive motor 213 rotates the second alignment gear 211 forward and backward based on a signal from the control unit 51. Accordingly, the second alignment shaft 203 can be rotated via the second alignment gear 211, and the second alignment unit 200 can be made to move back and forth between the second retracted position P2 and the second alignment position K2.

(Control of Width-Direction Alignment Unit)

The control unit 51 controls the operation of the width-direction alignment unit 120 equipped with the first alignment mechanism 121 and the second alignment mechanism 122 configured as described above. Note that the control unit 51 performs appropriate control while detecting banknotes S based on various sensors (for example, non-contact sensors such as photoelectric sensors, contact sensors, and the like) and the operating positions of the first alignment mechanism 121 and second alignment mechanism 122.

In particular, the control unit 51, according to the denomination of the banknote S preset by the operation display unit 50, moves the first base unit 140 and the second base unit 180 along the front-rear direction L3 to adjust the spacing between the first alignment unit 160 and the second alignment unit 200. Thereby, according to the width of the banknotes S, the first alignment unit 160 and the second alignment unit 200 can be arranged facing each other in the front-rear direction L3 at an optimum spacing.

More specifically, the control unit 51 controls the first base unit 140 and the second base unit 180 to move along the front-rear direction L3 so that the inverval in the front-rear direction L3 between the first planar contact unit 162 and the second planar contact unit 202 matches the horizontal width of the banknotes S to be accumulated on the upper base unit 112 when the first alignment unit 160 and the second alignment unit 200 have been positioned in the first alignment position K1 and second alignment position K2.

Figure 12:
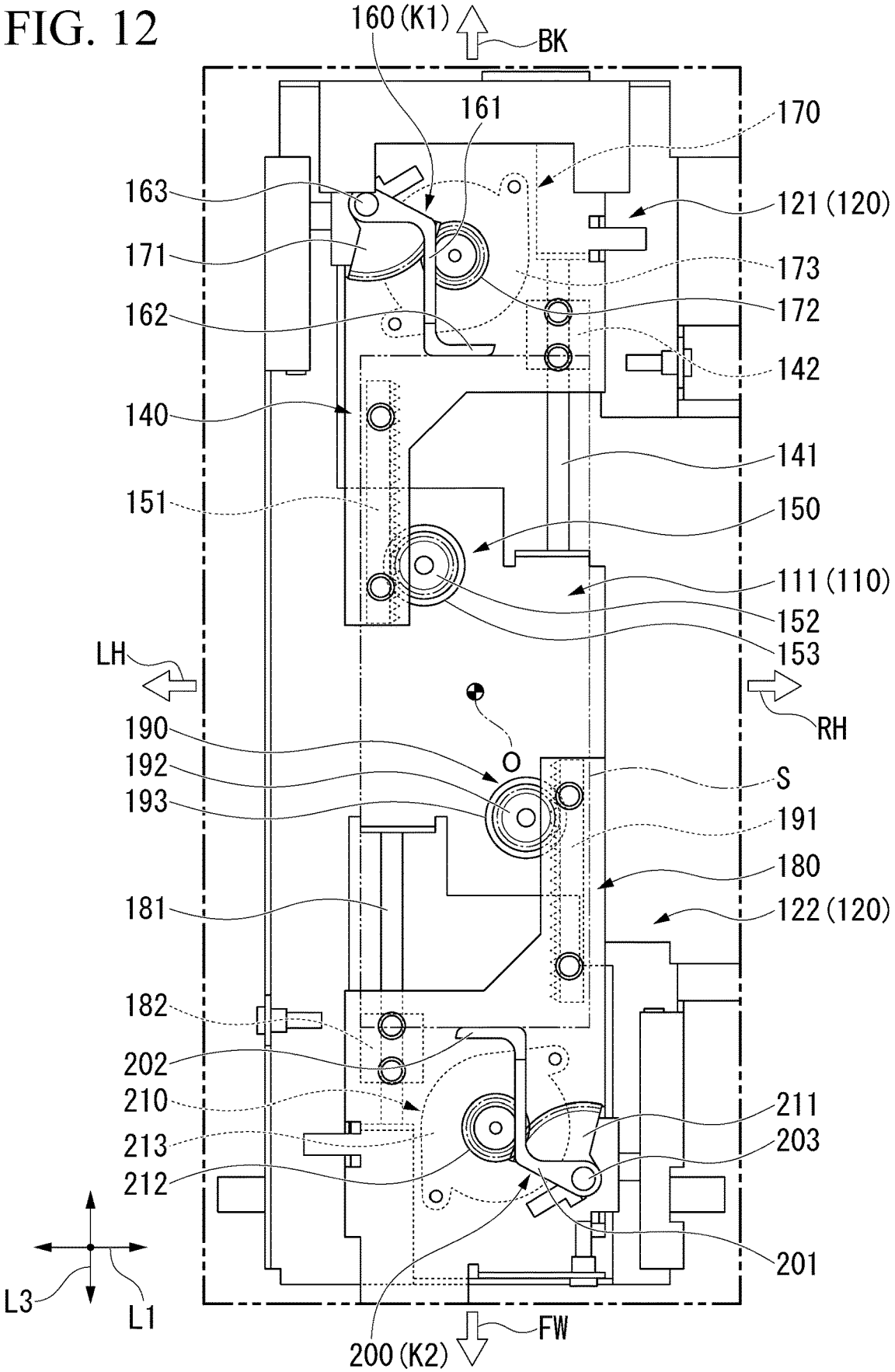
FIG. 12 is a plan view showing a state in which the spacing between the first base unit and the second base unit of the width-direction alignment unit shown in FIG. 11 is widened.

As a result, it is possible to flexibly deal with banknotes S having small horizontal widths as shown in FIG. 11 and banknotes S having large horizontal widths as shown in FIG. 12.

Subsequently, the control unit 51 performs control so as to rotate the first alignment unit 160 and the second alignment unit 200 from the first retracted position P1 and the second retracted position P2 to the first alignment position K1 and the second alignment position K2, respectively, to tap the banknotes S accumulated in the upper base unit 112 from both sides in the horizontal width direction, and thereby align the banknotes S in the horizontal width direction.

At this time, in the present embodiment, the control unit 51 performs control so as to simultaneously rotate the first alignment unit 160 and the second alignment unit 200 to so as to shift from the first retracted position P1 and the second retracted position P2 to the first alignment position K1 and the second alignment position K1.

(First Accumulation and Storage Unit: Conveyance Direction Alignment Unit)

As shown in FIG. 8, the conveyance direction alignment unit 130 is provided with a third alignment mechanism 131 and a fourth alignment mechanism 132 arranged to face each other in the left-right direction L1 with the upper base unit 112 interposed therebetween. The conveyance direction alignment unit 130 mainly uses the main accumulation area 113 to align the banknotes S accumulated on the upper base unit 112 in the conveyance direction (vertical width direction).

The third alignment mechanism 131 is located more on the right side RH of the apparatus than the upper base unit 112 and is provided so as to be movable relative to the upper base unit 112 in the left-right direction L1. In contrast, the fourth alignment mechanism 132 is located more on the left side LH of the apparatus than the upper base unit 112 and is provided so as to be movable relative to the upper base unit 112 in the left-right direction L1.

(Conveyance Direction Alignment Unit: Third Alignment Mechanism)

Figure 13:
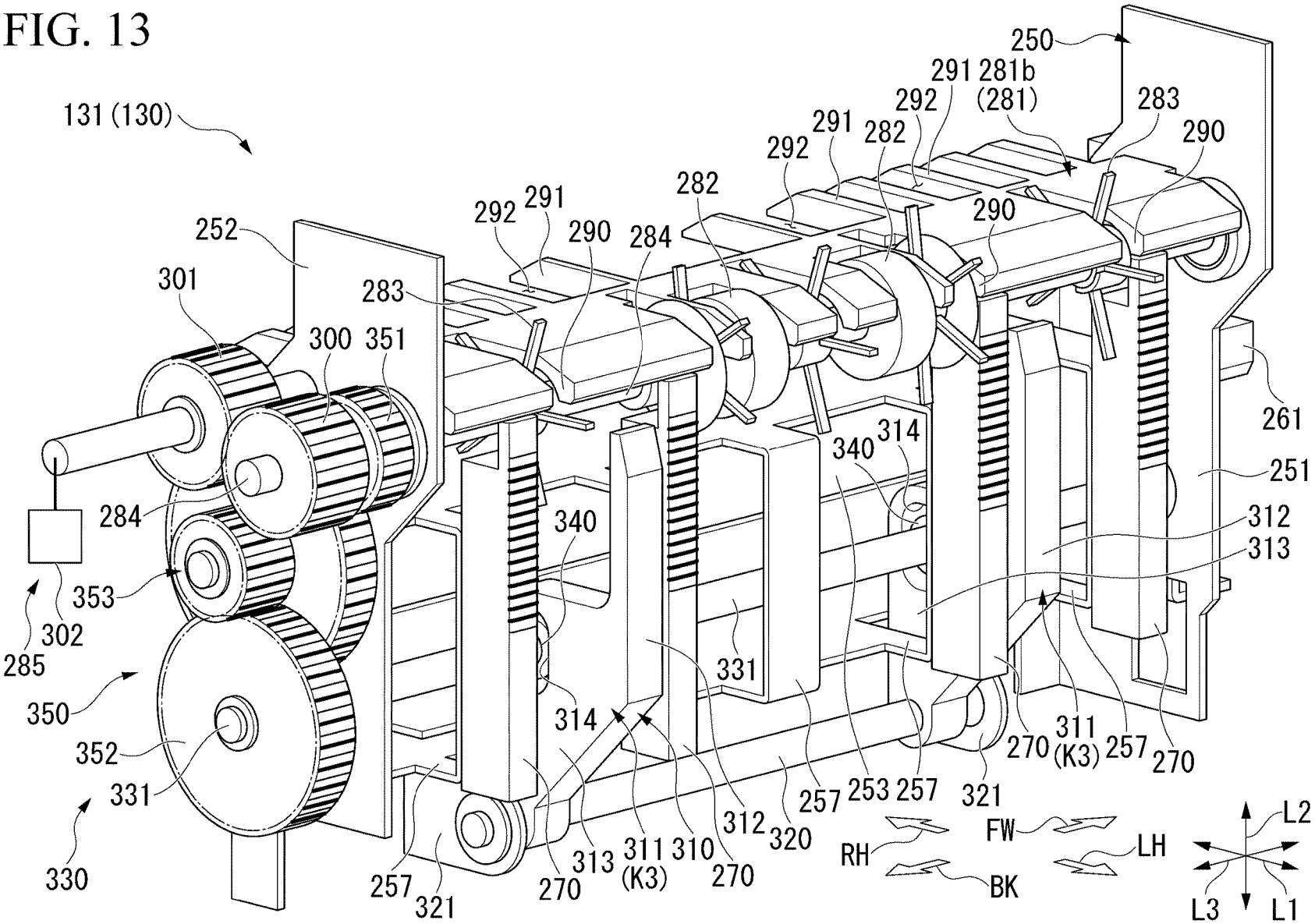
FIG. 13 is a perspective view showing a third alignment mechanism of the first accumulation and storage unit shown in FIG. 8.
Figure 14:
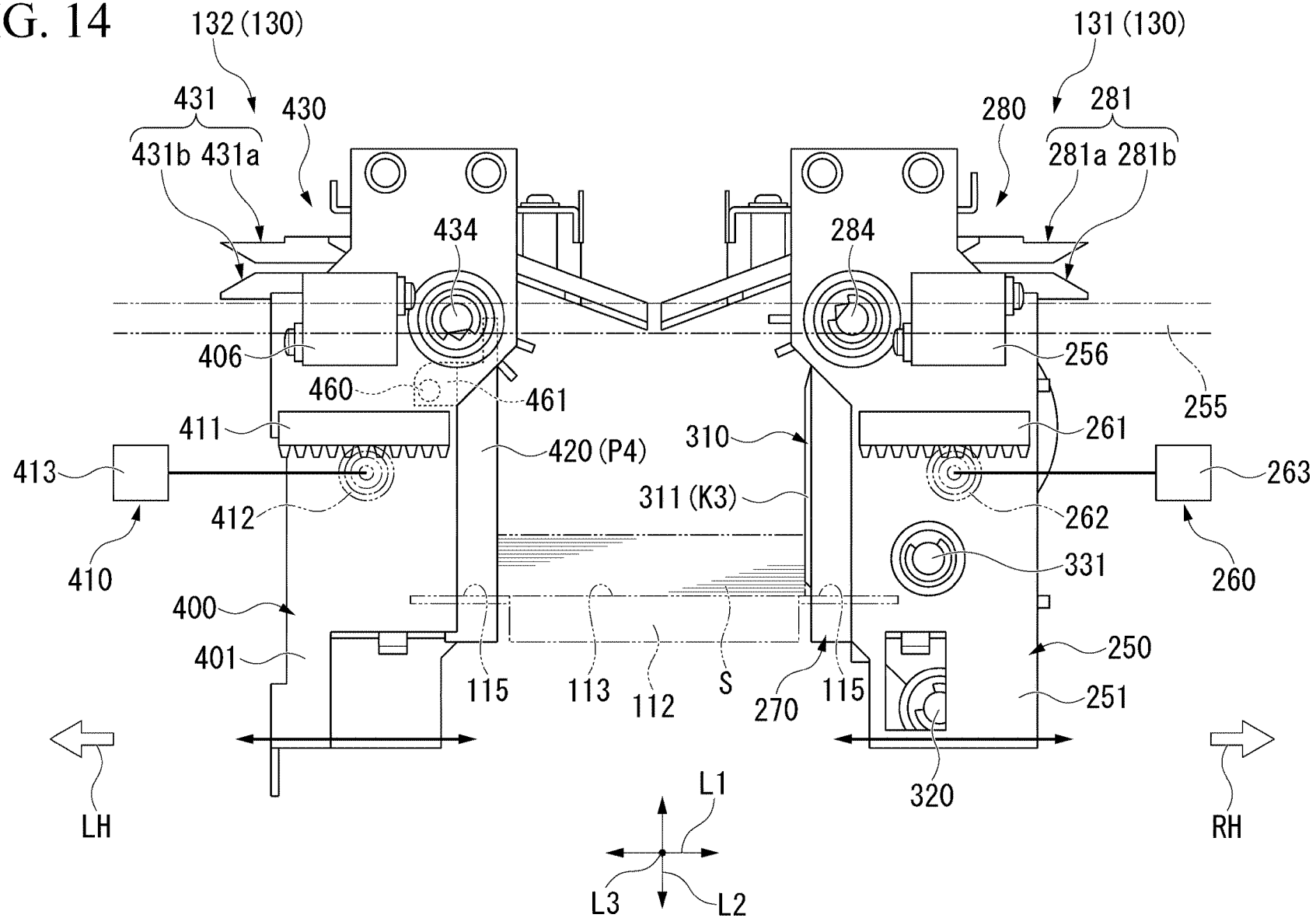
FIG. 14 is a side view showing the third alignment mechanism and fourth alignment mechanism of the first accumulation and storage unit shown in FIG. 8.

As shown in FIGS. 8, 13 and 14, the third alignment mechanism 131 is provided with a third base unit 250, a third base drive unit 260, a third stopper unit 270 provided on the third base unit 250, a third conveyance unit (third accumulation conveyance unit according to the present invention) 280 provided in the third base unit 250, and a third alignment unit 310. The third base unit 250 is movable in the left-right direction L1 with respect to the upper base unit 112. The third base drive unit 260 drives the third base unit 250.

The third base unit 250 is, for example, a thin metal plate, and is arranged above the upper base unit 112 and is arranged on the right side RH of the upper base unit 112. The third base unit 250 has a front wall 251 and a rear wall 252 facing each other in the front-rear direction L3, and a right wall 253 coupling the front wall 251 and the rear wall 252 in the front-rear direction L3. The front wall 251 and the rear wall 252 are arranged on the outer side of the upper base unit 112 in the front-rear direction L3. Furthermore, the right wall 253 is arranged on the right side RH of the upper base unit 112.

In the front wall 251 of the third base unit 250 is provided a third linear motion guide unit 256 through which a guide shaft 255 that is fixed in the device case 60 is inserted to linearly guide the guide shaft 255.

The guide shaft 255 is a cylindrical rod arranged more to the front FW side than the front wall 251 and linearly extending along the left-right direction L1. The third linear motion guide unit 256 is a guide member such as a linear ball bearing, which is arranged in the front wall 251 and has the guide shaft 255 slidably fitted therein. Thereby, the third base unit 250 is supported so as to be movable along the left-right direction L1 with high-precision straightness while being guided by the guide shaft 255. A plurality of stopper mounting units 257 projecting toward the left side LH are formed in the right wall 253 of the third base unit 250. The plurality of stopper mounting units 257 are arranged at spacings in the front-rear direction L3 corresponding to the plurality of expansion accommodation holes 114 formed in the right end portion of the upper base unit 112.

The plurality of stopper mounting units 257 enter into each of the plurality of expansion accommodation holes 114 from the right side RH. A third stopper unit 270 is fixed to each of the plurality of stopper mounting units 257. The third stopper unit 270 is formed vertically extending in the vertical direction L2, receives the banknotes S discharged from the inverting unit 92 side, and guides the banknotes S toward the upper base unit 112.

In the illustrated example, the case where the third base unit 250 is provided with four third stopper units 270 is taken as an example. These third stopper units 270 are movable within the expansion accommodation hole 114 as the third base unit 250 moves in the left-right direction L1.

The third base drive unit 260 is provided with a third rack gear 261, a third pinion gear 262, and a third base drive motor 263. The third rack gear 261 is fixed to the front wall 251 of the third base unit 250. The third pinion gear 262 meshes with the third rack gear 261. The third base drive motor 263 drives the third pinion gear 262 directly or indirectly via a base relay gear or the like.

The third rack gear 261 is formed in a linear shape extending along the left-right direction L1, and is fixed to the right wall 253 with the rack teeth directed downward. The third base drive motor 263 is, for example, a stepping motor, and its operation is controlled by the control unit 51, and rotates the third pinion gear 262 forward and backward based on signals from the control unit 51. As a result, the third base unit 250 can be moved in the left-right direction L1 while being guided by the guide shaft 255 via the third rack gear 261.

In this manner, the third base unit 250 can be moved in the left-right direction L1. By moving the third base unit 250 according to the size (vertical width) of the banknote S, it is possible to handle banknotes S of various sizes.

The third conveyance unit 280 is provided at the upper unit of the third base unit 250, and in addition to receiving the banknotes S discharged from the non-inverting unit 91 also loads the banknotes S into the upper base unit 112. The third conveyance unit 280 is provided with a third conveyance path 281, a third conveyance roller 282, a third impeller 283, and a third conveyance drive unit 285.

As shown in FIG. 14, the third conveyance path 281 has a third upper conveyance guide 281*a* and a third lower conveyance guide 281*b* arranged with a gap in the vertical direction L2.

As shown in FIGS. 8 and 13, the third lower conveyance guide 281*b* is arranged on the upper side of the third base unit 250. The third lower conveyance guide 281*b* is fixed so as to span between the front wall 251 and the rear wall 252. The third lower conveyance guide 281*b* is formed in a rectangular shape in plan view that is longer in the front-rear direction L3 than in the left-right direction L1, with the upper surface serving as a guide surface for guiding the banknotes S.

A plurality of slit holes 290 are formed in the third lower conveyance guide 281*b* so as to pass through the third lower conveyance guide 281*b* in the vertical direction L2 and open to the left side LH. The slit holes 290 are formed in a horizontally long shape extending along the left-right direction L1, and are formed in plurality at intervals in the front-rear direction L3.

Joint projections 291 are formed at the right end of the third lower conveyance guide 281*b* so as to extend toward the right side RH. The joint projections 291 are formed to extend linearly, and are formed in a plurality at intervals in the front-rear direction L3. As a result, the plurality of joint projections 291 are formed in a comb shape. Also, a gap between the joint projections 291 adjacent in the front-rear direction L3 is a joint accommodation unit 292 that opens to the right side RH.

Here, as shown in FIG. 8, a joint projection 91*d* and a joint accommodation unit 91*e* are formed in the left end (outlet) of the third non-inverting unit 91*c*, which constitutes the non-inverting unit 91. The joint projection 91*d* and the joint accommodation unit 91*e* correspond to the joint projection 291 and the joint accommodation unit 292, respectively, and are combined with the joint projection 291 and the joint accommodation unit 292, respectively.

The joint projections 291 on the side of the third non-inverting unit 91*c* are formed to extend linearly toward the left side LH. A plurality of the joint projections 91*d* are formed in a comb-teeth shape so as to enter the joint accommodation units 292 on the side of the third lower conveyance guide 281*b*. Therefore, the joint projections 91*d* on the side of the third non-inverting unit 91*c* are accommodated in the joint accommodation units 292 on the side of the third lower conveyance guide 281*b* so as to be movable in the left-right direction L1.

The joint accommodation units 91*e* on the side of the third non-inverting unit 91*c* are formed between the joint projections 91*d* adjacent to each other in the front-rear direction L3, and the joint projections 291 on the side of the third lower conveyance guide 281*b* are capable of entering therein. Accordingly, the joint projections 291 on the side of the third lower conveyance guide 281*b* are accommodated in the joint accommodation units 91*e* on the side of the third non-inverting unit 91*c* so as to be movable in the left-right direction L1.

As described above, the joint projections 291 and joint accommodation units 292 on the side of the third lower conveyance guide 281*b* are combined with the joint projections 91*d* and joint accommodation units 91*e* on the side of the third non-inverting unit 91*c*. As a result, even if the third alignment mechanism 131 moves in the left-right direction L1, which is the conveyance direction, the coupled state between the third lower conveyance guide 281*b* and the third non-inverting unit 91*c* can be stably maintained without being affected by this movement. Therefore, it is possible to appropriately transfer the banknotes S from the third non-inverting unit 91*c* to the upper surface of the third lower conveyance guide 281*b*.

As shown in FIG. 14, the third upper conveyance guide 281*a* is formed in a rectangular shape in plan view that is longer in the front-rear direction L3 than in the left-right direction L1. The third upper conveyance guide 281*a* is arranged to cover the entire third lower conveyance guide 281*b* from above, and is fixed so as to span between the front wall 251 and the rear wall 252 of the third base unit 250. The lower surface of the third upper conveyance guide 281*a* serves as a guide surface for guiding the banknotes S. Thereby, the banknotes S conveyed from the non-inverting unit 91 can be conveyed toward the upper base unit 112 between the upper surface of the third lower conveyance guide 281*b* and the lower surface of the third upper conveyance guide 281*a*.

A plurality of joint projections and a plurality of joint accommodation units are also formed in the right end unit of the third upper conveyance guide 281*a* similarly to the third lower conveyance guide 281*b*, and these are combined with the third non-inverting unit 91*c*.

Furthermore, the third upper conveyance guide 281*a* protrudes toward the left side LH more than the third lower conveyance guide 281*b*. The third upper conveyance guide 281*a* is inclined obliquely downward so as to extend downward toward the upper base unit 112 side. This allows the banknotes S conveyed from the non-inverting unit 91 to be reliably guided while the banknotes S are conveyed and accumulated as they are dropped toward the upper base unit 112.

As shown in FIGS. 8 and 13, the third conveyance roller 282 and the third impeller 283 are each arranged in a slit hole 290 formed in the third lower conveyance guide 281*b*. In the illustrated example, two third conveyance rollers 282 and five third impellers 283 are provided. However, the numbers of the third conveyance rollers 282 and the third impellers 283 are not limited to this case, and may be changed as appropriate.

The third conveyance roller 282 and the third impeller 283 are attached to a third conveyance shaft 284 arranged between the front wall 251 and the rear wall 252 of the third base unit 250 along the front-rear direction L3. The third conveyance shaft 284 is arranged substantially directly below the third lower conveyance guide 281*b* and is rotatably supported by the front wall 251 and the rear wall 252. Thereby, by rotating the third conveyance shaft 284, the third conveyance rollers 282 and the third impellers 283 can be rotated, and the banknotes S can be conveyed.

The third conveyance drive unit 285 is provided with a third conveyance gear 300 provided on the third conveyance shaft 284, a third intermediate gear 301 that meshes with the third conveyance gear 300, and a third conveyance drive motor 302 that drives the third intermediate gear 301.

The third conveyance shaft 284 protrudes rearward from the rear wall 252 of the third base unit 250 toward the rear BK side, and the third conveyance gear 300 is fixed to the rear end unit of the third conveyance shaft 284. The third relay gear 301 is arranged further to the rear BK side than the rear wall 252 of the third base unit 250 and is fixed to the drive shaft of the third conveyance drive motor 302.

The third conveyance drive motor 302 is, for example, a stepping motor. The operation of the third conveyance drive motor 302 is controlled by the control unit 51. The third conveyance drive motor 302 rotates the third conveyance shaft 284 via the third relay gear 301 and the third conveyance gear 300 based on a signal from the control unit 51. Thereby, the third conveyance roller 282 and the third impeller 283 can be rotated together with the third conveyance shaft 284, and it becomes possible to convey the banknotes S that have been conveyed between the third upper conveyance guide 281*a* and the third lower conveyance guide 281*b* from the non-inverting unit 91 toward the upper base unit 112.

The third alignment unit 310 is provided with an alignment plate 311 provided in the third base unit 250 and an alignment plate drive unit 330 that drives the alignment plate 311 in conjunction with the third conveyance rollers 282.

As shown in FIG. 13, the alignment plate 311 is formed in a vertically long shape extending in the vertical direction L2, and is arranged so as to be aligned with the third stopper unit 270 in the left-right direction L1. In the illustrated example, two of the alignment plates 311 are arranged adjacent to the two third stopper units 270. However, the number of alignment plates 311 is not limited to two, and at least one should be arranged.

The alignment plate 311 includes a vertically long contact unit 312 and an alignment plate main body 313. The contact unit 312 has a flat contact surface facing the upper base unit 112 side. The alignment plate main body 313 is integrally formed with the contact unit 312 and extends more toward the right side RH and lower than the third stopper unit 270. The contact unit 312 can come into contact with one edge positioned in the vertical width direction of the banknotes S.

Figure 15:
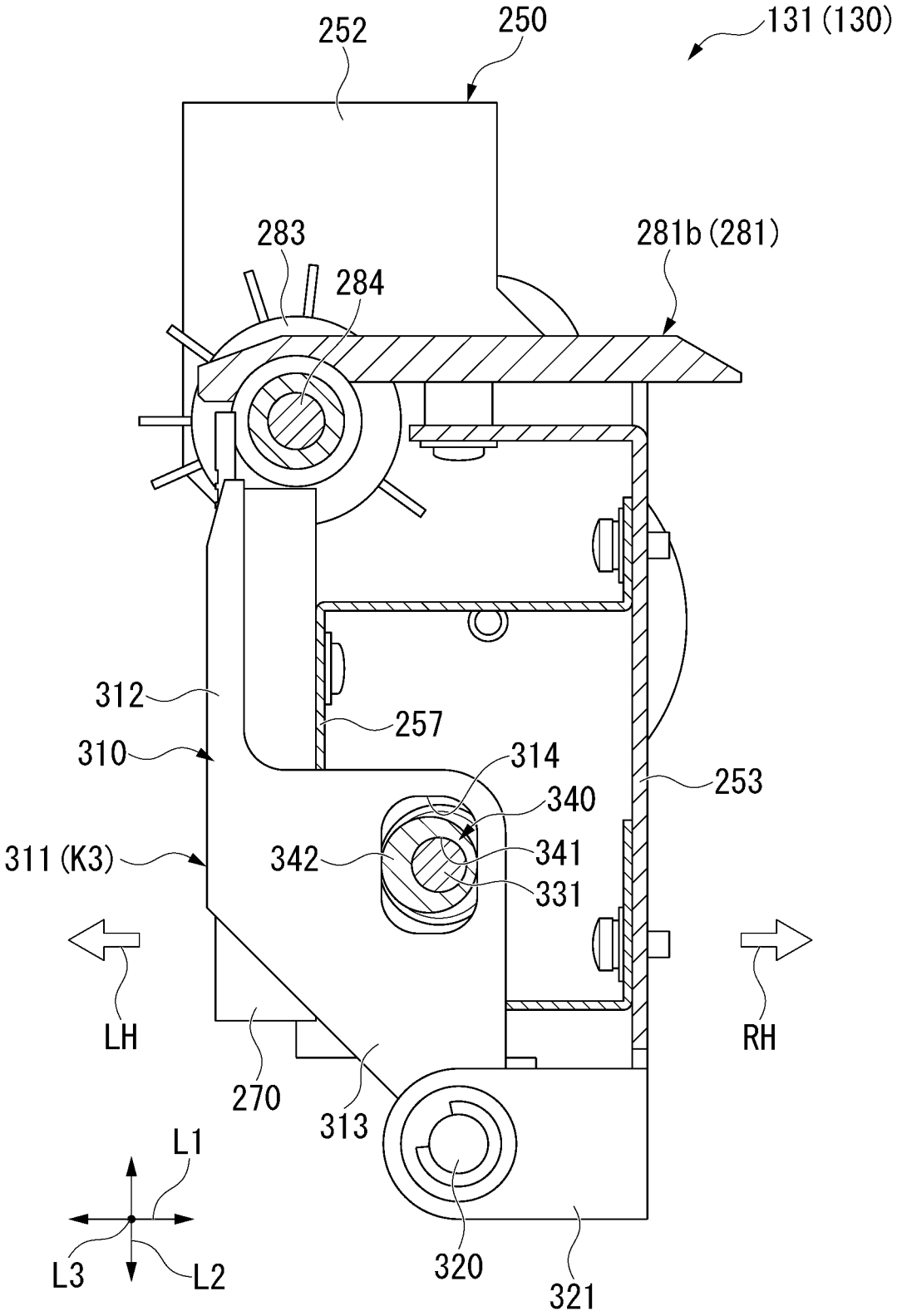
FIG. 15 is a side view showing the alignment plate of the third alignment mechanism shown in FIG. 13 and the peripheral mechanisms thereof.

As shown in FIGS. 13 and 15, a receiving hole 314 penetrating the alignment plate body 313 in the front-rear direction L3 is formed in the alignment plate body 313. The receiving hole 314 is formed in a vertically long shape that is longer in the vertical direction L2 than in the left-right direction L1.

The lower end unit of the alignment plate body 313 is rotatably attached to an alignment shaft 320 pivotally supported by the third base unit 250. The alignment shaft 320 is arranged along the front-rear direction L3, and both sides of the alignment shaft 320 are pivotally supported by support pieces 321 integrally formed with the rear wall 252 of the third base unit 250.

Accordingly, the alignment plate 311 can swing about the alignment shaft 320 in the left-right direction L1.

Figure 16:
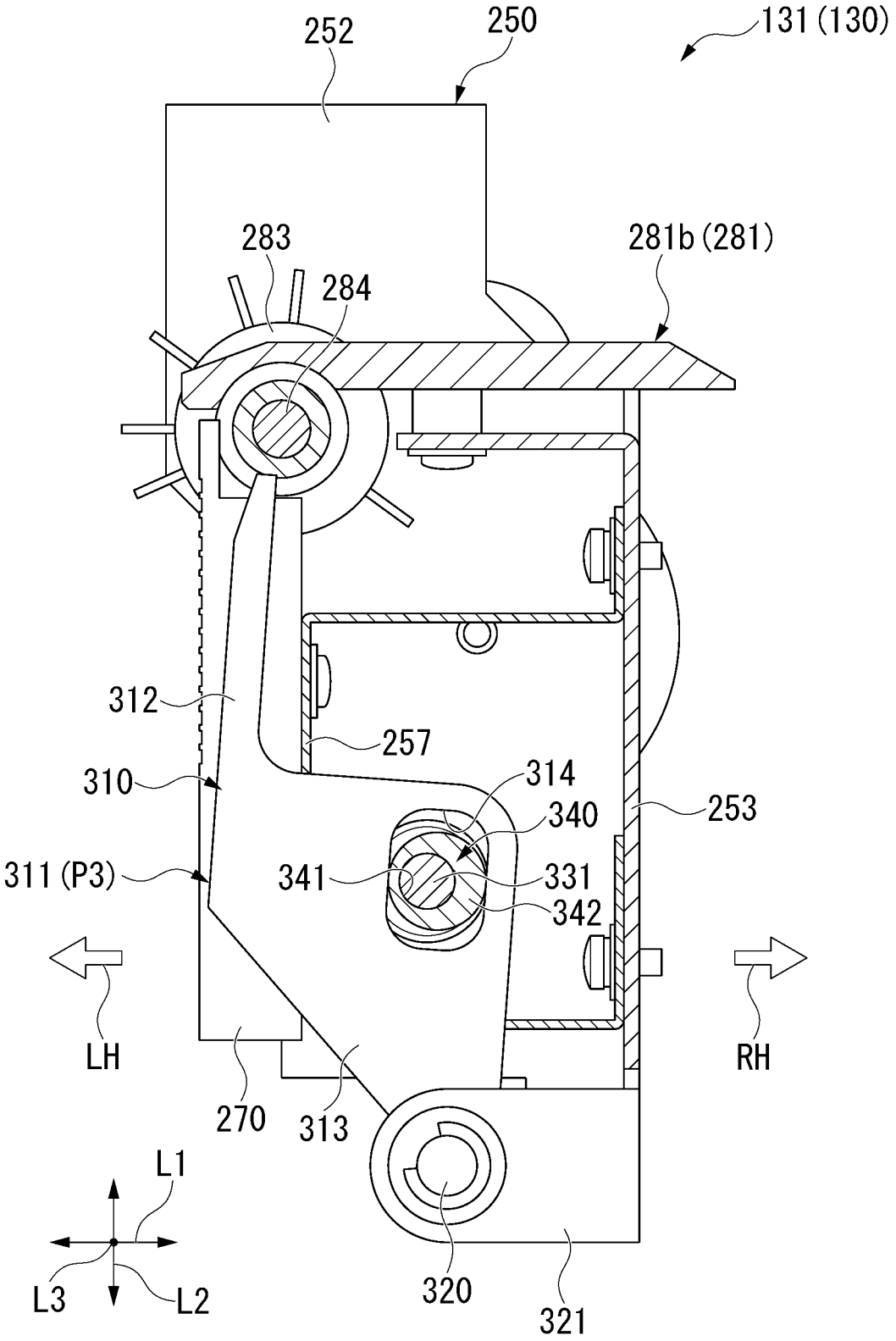
FIG. 16 is a side view showing a state in which the alignment plate shown in FIG. 15 is positioned at a third retracted position.

Specifically, the alignment plate 311 is swingable (movable) between a third alignment position K3 shown in FIGS. 13 and 15 and a third retracted position P3 shown in FIG. 16. At the third alignment position K3, the contact unit 312 protrudes more to the left side LH than the stopper portion and contacts one edge in the vertical width direction of the banknotes S accumulated on the upper base unit 112. At the third retracted position P3, the contact unit 312 retracts more to the right side RH than the stopper portion and separates from the banknotes S accumulated on the upper base unit 112.

The alignment plate 311 is accommodated together with the third stopper unit 270 in the expansion accommodation hole 114 provided in the upper base unit 112.

As shown in FIGS. 13 and 15, the alignment plate drive unit 330 is provided with an alignment plate drive shaft 331, an eccentric cam 340, and an alignment plate drive transmission unit 350.

The alignment plate drive shaft 331 is positioned below the third conveyance shaft 284 and above the alignment shaft 320, and is arranged between the front wall 251 and the rear wall 252 of the third base unit 250 along the front-rear direction L3. The alignment plate drive shaft 331 is rotatably supported by the front wall 251 and the rear wall 252 while passing through the receiving hole 314 formed in the alignment plate 311. The alignment plate drive shaft 331 projects rearward from the rear wall 252 of the third base unit 250 toward the rear BK side.

The eccentric cam 340 is arranged in the vertically elongated receiving hole 314 formed in the alignment plate 311. The eccentric cam 340 is an eccentric disc cam having an outer diameter that contacts the inner surface of receiving hole 314. The eccentric cam 340 is formed with an eccentric hole 341 passing through the eccentric cam 340 in the front-rear direction L3. The eccentric hole 341 is formed at a position eccentric from the center of the eccentric cam 340. Thereby, the eccentric cam 340 is formed so that the wall thickness (thickness in the radial direction) varies in the circumferential direction.

The eccentric cam 340 has the alignment plate drive shaft 331 inserted into the eccentric hole 341 and is thereby integrally combined with the alignment plate drive shaft 331. Therefore, the eccentric cam 340 eccentrically rotates around the alignment plate drive shaft 331 as the alignment plate drive shaft 331 rotates. Accordingly, the eccentric rotation of the eccentric cam 340 can be used to swing the alignment plate 311 between the third alignment position K3 and the third retracted position P3.

Specifically, the eccentric rotation of the eccentric cam 340 accompanying the rotation of the alignment plate drive shaft 331 causes the maximum wall thickness unit 342 to contact the portion of the inner surface of the receiving hole 314 that is on the contact unit 312 side, as shown in FIG. 15. Accordingly, the eccentric cam 34 can position the alignment plate 311 at the third alignment position K3. In contrast, as shown in FIG. 16, the eccentric rotation of the eccentric cam 340 accompanying the rotation of the alignment plate drive shaft 331 causes the maximum wall thickness unit 342 to contact the portion of the inner surface of the receiving hole 314 that is on the opposite side of the contact unit 312. Accordingly, the eccentric cam 34 can position the alignment plate 311 at the third retracted position P3.

As shown in FIG. 13, the alignment plate drive transmission unit 350 has a conveyance branch gear 351, an alignment plate gear 352, and an alignment plate relay gear 353.

The conveyance branch gear 351 is provided on the third conveyance shaft 284 and arranged between the third conveyance gear 300 and the rear wall 252 of the third base unit 250. Thereby, the conveyance branch gear 351 rotates together with the third conveyance shaft 284, the third conveyance rollers 282 and the third impellers 283.

The alignment plate gear 352 is provided at the rear end of the third base unit 250, protruding more toward the rear BK side than the rear wall 252.

The alignment plate relay gear 353 is arranged between the third conveyance gear 300 and the conveyance branch gear 351 and is pivotally supported by the rear wall 252 of the third base unit 250. The alignment plate relay gear 353 meshes with each of the third conveyance gear 300 and the conveyance branch gear 351.

As a result, the alignment plate relay gear 353 can transmit the rotational force of the conveyance branch gear 351 to the alignment plate gear 352, interlocking with the rotation of the third conveyance shaft 284, which can rotate the alignment plate drive shaft 331 and eccentric cam 340 in conjunction with the rotation of the third conveyance shaft 284, the third conveyance rollers 282 and the third impellers 283. Therefore, the alignment plate 311 can be continuously swung between the third alignment position K3 and the third retracted position P3 in conjunction with the rotation of the third conveyance rollers 282 and the like.

(Conveyance Direction Alignment Unit: Fourth Alignment Mechanism)

As shown in FIG. 8, the fourth alignment mechanism 132 is arranged more on the left side LH of the apparatus than the upper base unit 112, and is positioned across the upper base unit 112 so as to face the third alignment mechanism 131 described above in the left-right direction L1. The fourth alignment mechanism 132 of this embodiment basically has the same configuration as the third alignment mechanism 131. The fourth alignment mechanism 132 is arranged in line-symmetry (left-right symmetry) with respect to the third alignment mechanism 131 when viewed from above.

Accordingly, in the fourth alignment mechanism 132, the same components as those of the third alignment mechanism 131 will be described simply by adding "fourth" instead of "third" to their names.

However, the fourth alignment mechanism 132 does not have a component corresponding to the third alignment unit 310.

As shown in FIGS. 8 and 14, the fourth alignment mechanism 132 is provided with a fourth base unit 400, a fourth base drive unit 410, a fourth stopper unit 420 provided in the fourth base unit 400, and a fourth conveyance unit (fourth accumulation conveyance unit according to the present invention) 430 provided in the fourth base unit 400. The fourth base unit 400 is movable in the left-right direction L1 with respect to the upper base unit 112. The fourth base drive unit 410 drives the fourth base unit 400.

The fourth base unit 400 has a front wall 401, a rear wall 402, and a left wall 403 coupling the front wall 401 and the rear wall 402 in the front-rear direction L3. The left wall 403 has a banknote discharge port 404 that penetrates the left wall 403 in the left-right direction L1 for discharging banknotes accumulated on the upper surface of the upper base unit 112 to the outside (left side LH) while maintaining the accumulated state.

In the front wall 401 of the fourth base unit 400 is provided a fourth linear motion guide unit 406 through which a guide shaft 255 that is fixed in the device case 60 is inserted to linearly guide the guide shaft 255. Thereby, the fourth base unit 400 is supported so as to be movable along the left-right direction L1 with high-precision straightness while being guided by the guide shaft 255.

The guide shaft 255 is a common guide shaft with the third base unit 250. However, the present invention is not limited to this case, and separate guide shafts may be used to guide the third base unit 250 and the fourth base unit 400, respectively.

The fourth base drive unit 410 is provided with a fourth rack gear 411, a fourth pinion gear 412, and a fourth base drive motor 413. The fourth rack gear 411 is fixed to the front wall 401 of the fourth base unit 400. The fourth pinion gear 412 meshes with the fourth rack gear 411. The fourth base drive motor 413 drives the fourth pinion gear 412 directly or indirectly via a base relay gear or the like.

The fourth base drive motor 413 is, for example, a stepping motor. The operation of the fourth base drive motor 413 is controlled by the control unit 51, and the fourth base drive motor 413 rotates the fourth pinion gear 412 forward and backward based on a signal from the control unit 51. As a result, the fourth base unit 400 can be moved in the left-right direction L1 while being guided by the guide shaft 255 via the fourth rack gear 411.

In this manner, the fourth base unit 400 can be moved in the left-right direction L1. By moving the fourth base unit 400 according to the size (vertical width) of the banknote S, it is possible to handle banknotes S of various sizes.

The fourth conveyance unit 430 is provided at the upper unit of the fourth base unit 400, and in addition to receiving the banknotes S discharged from the inverting unit 92 also loads the banknotes S into the upper base unit 112. The fourth conveyance unit 430 is provided with a fourth conveyance path 431, a fourth conveyance roller 432, a fourth impeller 433, and a fourth conveyance drive unit 435.

As shown in FIG. 14, the fourth conveyance path 431 has a fourth upper conveyance guide 431*a* and a fourth lower conveyance guide 431*b* arranged with a gap in the vertical direction L2.

As shown in FIG. 8, the fourth lower conveyance guide 431*b* is formed with a plurality of slit holes 440 that pass through the fourth lower conveyance guide 431*b* in the vertical direction L2 and open to the right side RH. A plurality of joint projections 441 are formed in comb-teeth shape toward the left side LH at the left end portion of the fourth lower conveyance guide 431*b*. A gap between the joint projections 441 adjacent in the front-rear direction L3 is a joint accommodation unit 442 that opens to the left side LH.

Here, a joint projection 92*d* and a joint accommodation unit 92*e* are formed in the right end (outlet) of the third inverting unit 92*c*, which constitutes the inverting unit 92. The joint projection 92*d* and the joint accommodation unit 92*e* correspond to the joint projection 441 and the joint accommodation unit 442, respectively, and are combined with the joint projection 441 and the joint accommodation unit 442, respectively. Accordingly, even if the fourth alignment mechanism 132 moves in the left-right direction L1, which is the conveyance direction, the coupled state between the fourth lower conveyance guide 431*b* and the third inverting unit 92*c* can be stably maintained without being affected by this movement, and it is possible to properly pass the banknotes S from the third inverting unit 92*c* to the upper surface of the fourth lower conveyance guide 431*b*.

The fourth conveyance roller 432 and the fourth impeller 433 are arranged in the slit holes 440 formed in the fourth lower conveyance guide 431*b*. The fourth impeller 433 is attached to a fourth conveyance shaft 434 arranged between the front wall 401 and the rear wall 402 of the fourth base unit 400. Thereby, by rotating the fourth conveyance shaft 434, the fourth conveyance rollers 432 and the fourth impellers 433 can be rotated, and the banknotes S can be conveyed.

The fourth conveyance drive unit 435 is provided with a fourth conveyance gear 450 provided on the fourth conveyance shaft 434, a fourth intermediate gear 451 that meshes with the fourth conveyance gear 450, and a fourth conveyance drive motor not shown that drives the fourth intermediate gear 451.

The fourth conveyance drive motor rotates the fourth conveyance shaft 434 via the fourth relay gear 451 and the fourth conveyance gear 450 based on a signal from the control unit 51. Thereby, the fourth conveyance roller 432 and the fourth impeller 433 can be rotated together with the fourth conveyance shaft 434, and it becomes possible to convey the banknotes S that have been conveyed between the fourth upper conveyance guide 431*a* and the fourth lower conveyance guide 431*b* from the inverting unit 92 toward the upper base unit 112.

By the way, between the front wall 401 and the rear wall 402 of the fourth base unit 400, a stopper shaft 460 extending along the front-rear direction L3 is supported. The stopper shaft 460 is arranged below the fourth conveyance shaft 434.

A plurality of fourth stopper units 420 are fixed to the stopper shaft 460 via attachment units 461 attached to the stopper shaft 460. The plurality of fourth stopper units 420 are arranged at intervals in the front-rear direction L3, and enter the plurality of expansion accommodation holes 114 formed in the upper base unit 112 from the left side LH. These fourth stopper units 420 are formed vertically extending in the vertical direction L2, and play the role of receiving the banknotes S discharged from the non-inverting unit 91 side, and guiding the banknotes S toward the upper base unit 112.

It should be noted that four fourth stopper units 420 are provided, for example, similarly to the third stopper unit 270. However, the number of fourth stopper units 420 is not limited to this case, and may be changed as appropriate.

The stopper shaft 460 to which the fourth stopper units 420 are fixed is rotationally driven by a fourth stopper drive unit (not shown). The fourth stopper drive unit has a stopper gear provided on the stopper shaft 460 and a stopper drive motor that drives the stopper gear directly or indirectly via a stopper intermediate gear or the like.

The stopper drive motor is, for example, a stepping motor. The operation of the stopper drive motor is controlled by the control unit 51, and the stopper drive motor rotates the stopper gear forward and backward based on a signal from the control unit 51. Accordingly, by rotating the stopper shaft 460, it is possible to rotate the fourth stopper units 420 around the stopper shaft 460.

Specifically, the fourth stopper unit 420 can be rotated between the closed position P4 (see FIG. 14) and the open position. At the closed position P4, the fourth stopper unit 420 closes the banknote discharge port 404 and receives the banknotes S discharged from the non-inverting unit 91 side. At the open position, the fourth stopper unit 420 can open the banknote discharge port 404 and discharge the banknotes S accumulated on the upper base unit 112 to the outside.

Note that when positioned at the closed position P4, the fourth stopper unit 420 receives the banknotes S discharged from the non-inverting unit 91 side and guides the banknotes S to the upper base unit 112.

(Control of Conveyance Direction Alignment Unit)

The control unit 51 controls the operation of the conveyance direction alignment unit 130 equipped with the third alignment mechanism 131 and the fourth alignment mechanism 132 configured as described above. Note that the control unit 51 performs appropriate control while detecting banknotes S based on various sensors (for example, non-contact sensors such as photoelectric sensors, contact sensors, and the like) and the operating positions of the third alignment mechanism 131 and fourth alignment mechanism 132.

In particular, the control unit 51, according to the denomination of the banknote S preset by the operation display unit 50, moves the third base unit 250 and the third base unit 250 along the left-right direction L1, to adjust the spacing between the third stopper unit 270 and the fourth stopper unit 420. Thereby, according to the vertical width of the banknote S, the third stopper unit 270 and the fourth stopper unit 420 can be positioned facing each other in the left-right direction L1 by the optimal spacing.

Figure 17:
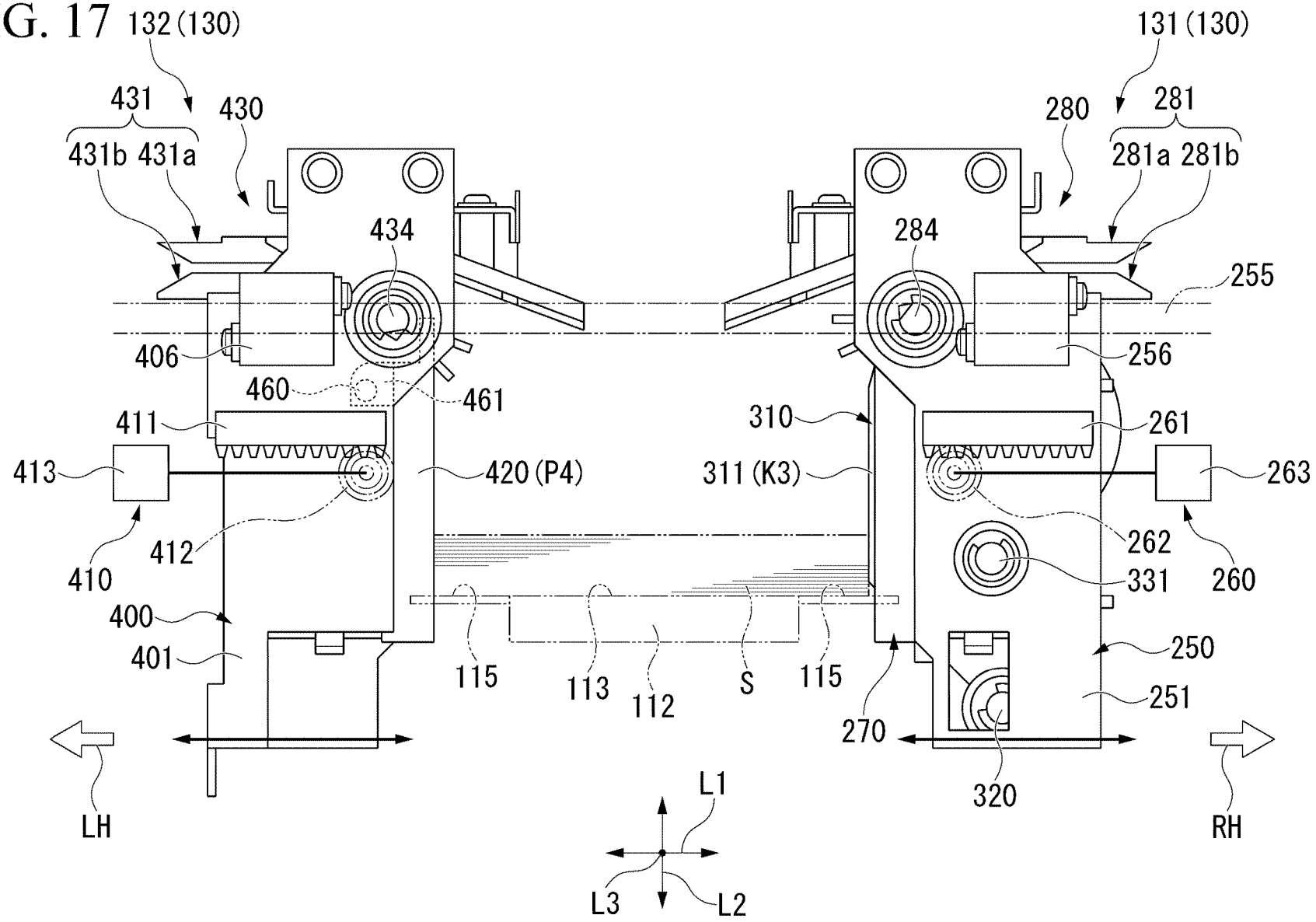
FIG. 17 is a plan view showing a state in which the spacing between the third base unit of the third alignment mechanism and the fourth base unit of the fourth alignment mechanism shown in FIG. 14 is widened.

As a result, it is possible to flexibly deal with banknotes S having small vertical widths as shown in FIG. 14 and banknotes S having large vertical widths as shown in FIG. 17. In particular, in the case shown in FIG. 17, banknotes S can be accumulated using the expansion accumulation area 115 in addition to the main accumulation area 113.

Moreover, in the state of the fourth stopper units 420 being positioned at the closed unit P4, the control unit 51, by causing the alignment plate 311 to swing from the third retracted position P3 to the third alignment position K3, taps banknotes S accumulated on the upper base unit 112 from one side in the vertical width direction. By this operation, the banknotes S are aligned in the vertical width direction between the fourth stopper units 420.

(Second Accumulation and Storage Unit)

As shown in FIG. 2, the second accumulation and storage unit 101 is arranged on the left side LH of the first accumulation and storage unit 100 with the accumulation conveyance unit 104 interposed therebetween, and has the same configuration as the first accumulation and storage unit 100. Therefore, a detailed description of the second accumulation and storage unit 101 is omitted.

However, since the second accumulation and storage unit 101 is arranged on the left side LH of the accumulation conveyance unit 104, the banknote discharge port 404 opens to the right side RH.

(Accumulation Conveyance Unit)

As shown in FIG. 2, the accumulation conveyance unit 104 is arranged between the first accumulation and storage unit 100 and the second accumulation and storage unit 101 configured as described above. Accordingly, the first accumulation and storage unit 100, the second accumulation and storage unit 101, and the accumulation conveyance unit 104 are arranged side by side in the left-right direction L1.

The accumulation conveyance unit 104 has, for example, a first chuck member 500 capable of clamping the accumulated banknotes S in the vertical direction L2. The first chuck member 500 is provided with a first chuck unit 501 located above the accumulated banknotes S and a second chuck unit 502 located below the accumulated banknotes S. The first chuck unit 501 and the second chuck unit 502 can be relatively moved closer to and away from each other in the vertical direction L2, and can hold the accumulated banknotes S in the vertical direction L2 while maintaining the orientation thereof.

The first chuck member 500 configured in this manner is movable between the first accumulation and storage unit 100 and the second accumulation and storage unit 101 along the left-right direction L1. Therefore, the accumulated banknotes S stored in the first accumulation and storage unit 100 can be taken out through the banknote discharge port 404, and the accumulated banknotes S stored in the second accumulation and storage unit 101 can be taken out through the banknote discharge port 404.

Further, the first chuck member 500 can transfer the accumulated banknotes S taken out from the first accumulation and storage unit 100 and the second accumulation and storage unit 101 to the second chuck member 510 of the bundling unit 103.

(Bundling Unit)

The bundling unit 103 is arranged below the accumulation conveyance unit 104 and includes the second chuck member 510 capable of receiving banknotes S in an accumulated state from the first chuck member 500 of the accumulation conveyance unit 104.

The second chuck member 510 is provided with a first chuck unit 511 located above the accumulated banknotes S and a second chuck unit 512 located below the accumulated banknotes S. The first chuck unit 511 and the second chuck unit 512 can be relatively moved closer to and away from each other in the vertical direction L2, and can hold the accumulated banknotes S in the vertical direction L2 while maintaining the orientation thereof.

The bundling unit 103 is further provided with a bundling mechanism unit 520 that bundles the banknotes S in the accumulated state sandwiched by the second chuck member 510 with a bundling tape (not shown), thereby creating a small bundle in which a plurality of banknotes S are bundled into a single bundle.

The bundling unit 103 further has, for example, a drawer-type small bundle discharge unit 521 for receiving the created small bundle. The small bundle discharge unit 521 is formed on the front surface of the device case 60 as shown in FIG. 1, and can be pulled out by the operator. Accordingly, the small bundle created by the bundling unit 103 can be taken out through the small bundle discharge unit 521.

However, the small bundle discharge unit 521 is not limited to a drawer type, and may be provided as an opening. Thus, the small bundle created by the bundling unit 103 can be discharged out of the apparatus through the small bundle discharge unit 521.

[Action of Banknote Handling Apparatus]

Next, a description will be given of a case where the banknote handling apparatus 1 configured as described above is used to process the banknotes S to produce a small bundle of banknotes S, for example, 10,000 yen notes.

First, as an initial setting, the operator inputs the denomination of the small bundle to be produced, the number of banknotes S to be made into the small bundle, and the like to the operation display unit 50, and also inputs the number of small bundles to be produced.

After these initial settings are made, the operator loads 10,000 yen banknotes S in an accumulated state into the loading unit 11 of the identification and counting device 2, as shown in FIGS. 1 and 2. At the time of loading, with regard to the front-back directionalities of the banknotes S, the four front-back patterns (first front orientation N1, first back orientation N2, second front orientation N3, and second back orientation N4) are mixed.

When the banknotes S are set in the loading unit 11, the banknotes S are taken in one by one by the feed-out roller 14 and the take-in roller 15 and transferred to the identification and conveyance unit 20, as shown in FIG. 2. Thereby, the banknotes S can be conveyed by the first identification and conveyance unit 21 and the second identification and conveyance unit 22.

During this time, the identification unit 30 counts the conveyed banknotes S, identifies the denomination of the banknotes S, identifies front and back patterns, and the like, and outputs identification information of the banknotes S to the control unit 51.

Based on the identification information output from the identification unit 30, the control unit 51, upon determining that the conveyed banknote S can be accepted and that the banknote S is of a preset denomination, conveys the banknote S from the second identification and conveyance unit 22 to the accumulation and bundling device 3 via the outbound conveyance unit 40.

Further, the control unit 51, upon determining that the conveyed banknote S is unacceptable based on the identification information output from the identification unit determines the banknote S to be a banknote S to be rejected, and has the banknote S conveyed from the second identification and conveyance unit 22 to the rejection unit 12 via the rejection conveyance unit 41.

Moreover, the control unit 51, upon determining that the conveyed banknote S can be accepted based on the identification information output from the identification unit 30 and determining that the banknote S is of a denomination other than the preset denomination, for example, upon determining that the banknote S is a 1,000-yen note different from the 10,000-yen note, determines the banknote S to be a banknote S to be rejected, and has the banknote S conveyed from the second identification and conveyance unit 22 to the rejection unit 12 via the rejection conveyance unit 41.

As a result, only the 10,000-yen bills S determined to be acceptable can be conveyed from the second identification and conveyance unit 22 to the outbound conveyance unit 40, while the other banknotes S can be conveyed to the rejection unit 12 via the rejection conveyance unit 41.

As described above, it is possible to use the identification and counting device 2 to extract only banknotes S of 10,000 yen notes that are determined to be acceptable and set in advance, and to deliver them to the coupled conveyance unit 70 of the accumulation and bundling device 3. At this time, the control unit 51 ascertains that each banknote S delivered from the identification and counting device 2 to the coupled conveyance unit 70 has one of the four front-rear patterns.

As shown in FIG. 7, when receiving the banknotes S from the identification and counting device 2, the coupled conveyance unit 70 conveys the banknotes S toward the downstream side. At this time, the branch sorting unit 93 in the first front-back inverting unit 81 receives an instruction from the control unit 51, and when the banknote S conveyed by the coupled conveyance unit 70 has the front-rear pattern of the first front orientation N1 and the first back orientation N2, sorts the banknote S so as to be conveyed to the branching conveyance unit 90. When the banknote S has the front-rear pattern of the second front orientation N3 and the second back orientation N4, the branch sorting unit 93 sorts the banknote S toward the second front-back inverting unit 82 side.

The branch sorting unit 93 in the second front-back inverting unit 82 receives an instruction from the control unit 51, and when the banknote S conveyed by the coupled conveyance unit 70 has the front-rear pattern of the second front orientation N3 and the second back orientation N4, sorts the banknote S so as to be conveyed to the branching conveyance unit 90.

When the banknote S is conveyed to the branching conveyance unit 90 in the first front-back inverting unit 81, based on the instruction from the control unit 51, the gate unit 94 switches the conveyance path so as to convey the banknote S in the first front orientation N1 to the non-inverting unit 91, and convey the banknote S in the first back orientation N2 to the inverting unit 92.

As a result, the paper sheet handling apparatus 1 can discharges the banknotes S in the first front orientation N1 from the non-inverting unit 91 while maintaining the first front orientation N1 as is by inverting the banknotes S twice with the non-inverting unit 91. The paper sheet handling apparatus 1 can discharge the banknotes S in the first back orientation N2 from the inverting unit 92 in a state in which the front-back directionalities have been changed to the first front orientation N1 by one inversion with the inverting unit 92.

As a result, the front-back directionalities of the banknotes S discharged from the non-inverting unit 91 and the inverting unit 92 can be unified to the first front orientation N1 by using the first front-back inverting unit 81. Accordingly, the banknotes S whose front-back directionality has been unified to the first front orientation N1 can be transferred to the first accumulation and storage unit 100, for example.

When the banknote S is conveyed to the branching conveyance unit 90 in the second front-back inverting unit 82, based on the instruction from the control unit 51, the gate unit 94 switches the conveyance path so as to convey the banknote S in the second front orientation N3 to the non-inverting unit 91, and convey the banknote S in the second back orientation N4 to the inverting unit 92. As a result, the banknote S in the second front orientation N3 can be discharged from the non-inverting unit 91 while maintaining the second front orientation N3 by inverting the banknotes S twice with the non-inverting unit 91, while the banknote S in the second back orientation N4 can be discharged from the inverting unit 92 in a state where the front-back directionality has been changed to the second front orientation N3 by one front-back inversion with the inverting unit 92.

As a result, the front-back directionalities of the banknotes S discharged from the non-inverting unit 91 and the inverting unit 92 can be unified to the second front orientation N3 by using the second front-back inverting unit 82. Therefore, the banknotes S whose front-back directionality has been unified to the second front orientation N3 can be transferred to the second accumulation and storage unit 101.

Here, in storing the banknotes S in the first accumulation and storage unit 100 and the second accumulation and storage unit 101, the control unit 51 preliminarily sets the spacing between the first base unit 140 and the second base unit 180 and the spacing between the third base unit 250 and the fourth base unit 400 to a spacing corresponding to the banknotes S.

Specifically, the control unit 51, upon recognizing that the denomination of the banknote S loaded based on the identification information of the identification unit 30 is a preset 10,000 yen note, reads the horizontal width direction and the vertical width direction of the 10,000-yen note from the data stored in the storage unit 51*a*. The control unit 51, on the basis of the read data, controls the first base unit 140 and the second base unit 180 to move along the front-rear direction L3 so that the spacing in the front-rear direction L3 between the first planar contact unit 162 and the second planar contact unit 202 matches the horizontal width of the 10,000-yen banknotes S to be accumulated on the upper base unit 112, when the first alignment unit 160 and the second alignment unit 200 have been positioned in the first alignment position K1 and second alignment position K2, as shown in FIG. 11.

In addition, the control unit 51 moves the first base unit 140 and the second base unit 180 along the front-rear direction L3 so that the first planar contact unit 162 and the second planar contact unit 202 are arranged to be equally spaced from the reference position O in the upper base 112, so that the reference position O in the upper base unit 112 and center of the banknote S in the horizontal width direction coincide.

Further, the control unit 51, according to the denomination of the banknote S preset by the operation display unit 50, moves the third base unit 250 and the fourth base unit 400 along the left-right direction L1, to adjust the spacing between the third stopper unit 270 and the fourth stopper unit 420. Thereby, as shown in FIG. 14, according to the vertical width of the 10,000-yen banknotes S accumulated on the upper base unit 112, the third stopper unit 270 and the fourth stopper unit 420 can be positioned facing each other in the left-right direction L1 by the optimal spacing.

A description will be given of how banknotes S discharged from the first front-back inverting unit 81 are stored in the first accumulation and storage unit 100 based on the initial settings described above.

For example, as shown in FIG. 8, when banknotes S whose front-back directionalities have been unified to the first front orientation N1 are transferred from the non-inverting unit 91 of the first front-back inverting unit 81 to the first accumulation and storage unit 100, the control unit 51 drives the third conveyance drive motor 302 to rotate the third conveyance shaft 284. As a result, the third conveyance rollers 282 and the third impellers 283 can be rotated, and banknotes S can be conveyed toward the upper base unit 112 through the space between the upper surface of the third lower conveyance guide 281*b* and the lower surface of the third upper conveyance guide 281*a*. Therefore, the banknotes S can be loaded onto the upper base unit 112.

Similarly, when banknotes S whose front-back directionalities have been unified to the first front orientation N1 are transferred from the inverting unit 92 to the first accumulation and storage unit 100, the control unit 51 drives the fourth conveyance drive motor to rotate the fourth conveyance shaft 434. As a result, the fourth conveyance rollers 432 and the fourth impellers 433 can be rotated, and banknotes S can be conveyed toward the upper base unit 112 through the space between the upper surface of the fourth lower conveyance guide 431*b* and the lower surface of the fourth upper conveyance guide 431*a*. Therefore, the banknotes S can be loaded onto the upper base unit 112.

In this way, the banknotes S discharged from the non-inverting unit 91 and the banknotes S discharged from the inverting unit 92 can for example be alternately loaded onto the upper base unit 112, and can be stored while being accumulated on the upper base unit 112.

When the banknotes S are stored on the upper base unit 112, the control unit 51 rotates the first alignment unit 160 and the second alignment unit 200 from the first retracted position P1 and the second retracted position P2 shown in FIG. 10 to the first alignment position K1 and the second alignment position K2 shown in FIG. 11 almost simultaneously each time banknotes S are stored on the upper base unit 112 or each time a predetermined number of banknotes S are stored. As a result, the control unit 51 taps the banknotes S accumulated on the upper base unit 112 from both sides in the horizontal width direction. Thereby, the short sides of the banknotes S can be neatly unified, and the banknotes S can be aligned in the horizontal width direction.

Moreover, since the first planar contact unit 162 and the second planar contact unit 202 are arranged at equal intervals from the reference position O on the upper base unit 112, the banknotes S can be aligned so that the center of the banknotes S in the horizontal width direction matches the center of the banknotes S in the front-rear direction L3 of the upper base unit 112 (that is, the center in the conveyance direction).

Furthermore, since the control unit 51 drives the third conveyance drive motor 302, the alignment plate drive shaft 331 can be rotated in conjunction with the rotation of the third conveyance rollers 282. As a result, the eccentric cam 340 can be rotated together with the alignment plate drive shaft 331, and the alignment plate 311 can be swung from the third retracted position P3 shown in FIG. 16 to the third alignment position K3 shown in FIG. 15. Therefore, the banknotes S accumulated on the upper base unit 112 can be tapped from one side in the vertical width direction. As a result, as shown in FIG. 14, the long sides of the banknotes S can be neatly unified, and the banknotes S can be aligned in the vertical width direction with respect to the fourth stopper unit 420.

Note that the alignment plate 311 may align the banknotes S each time they are accumulated on the upper base unit 112, or may perform the alignment once every multiple number of sheets, such as once every two sheets, for example.

As described above, banknotes S (10,000 yen notes) whose front-back directionality are unified in the first front orientation N1 can be stored in the first accumulation and storage unit 100 while being neatly accumulated in a state of being aligned in the horizontal and vertical width directions.

As in the case described above, by transferring the banknotes S from the second front-back inverting unit 82 into the second accumulation and storage unit 101, banknotes S (10,000 yen notes) whose front-back directionality are unified in the second front orientation N3 can be stored in the second accumulation and storage unit 101 while being neatly accumulated in a state of being aligned in the horizontal and vertical width directions.

Next, when a predetermined number (for example, 100) of banknotes S are accumulated in the first accumulation and storage unit 100 and the second accumulation and storage unit 101, as shown in FIG. 2, the control unit 51 controls the accumulation conveyance unit 104 to remove the banknotes S in the accumulated state from the first accumulation and storage unit 100 and the second accumulation and storage unit 101 respectively, and convey them to the bundling unit 103.

Specifically, the control unit 51 drives the stopper drive motors in the first accumulation and storage unit 100 and the second accumulation and storage unit 101 to move the fourth stopper units 420 from the closed position P4 (see FIG. 14) to the open position. As a result, the banknote discharge port 404 can be opened, and the accumulated banknotes S can be taken out.

Next, the control unit 51 moves the first chuck member 500 of the accumulation conveyance unit 104 toward the first accumulation and storage unit 100 side, and after removing the banknotes in an accumulated state stored on the upper base unit 112 of the first accumulation and storage unit 100, transfers the banknotes S to the second chuck member 510 in the bundling unit 103.

Subsequently, the control unit 51 controls the bundling unit 103 to have the accumulated banknotes S received by the second chuck member 510 bundled by the bundling mechanism unit 520. As a result, a small bundle in which the banknotes S in the accumulated state are bundled with the bundling tape can be created.

Similarly, the control unit 51 moves the first chuck member 500 of the accumulation conveyance unit 104 toward the second accumulation and storage unit 101 side, and after removing the banknotes in an accumulated state stored on the upper base unit 112 of the second accumulation and storage unit 101, transfers the banknotes S to the second chuck member 510 in the bundling unit 103.

Subsequently, the control unit 51 controls the bundling unit 103 to have the accumulated banknotes S received by the second chuck member 510 bundled by the bundling mechanism unit 520. As a result, a small bundle in which the banknotes S in the accumulated state are bundled with the bundling tape can be created.

In this manner, the accumulated banknotes S stored in the first accumulation and storage unit 100 and the second accumulation and storage unit 101 can for example be taken out alternately and made into small bundles by the bundling unit 103.

The small bundles that are created are loaded into the small bundle discharge unit 521 shown in FIG. 1. This allows the operator to take out and collect the small bundles from the small bundle discharge unit 521. In particular, this small bundle is a bundle of banknotes S (10,000 yen notes) in which the front-back directionality of the banknotes S are unified and the banknotes S are neatly accumulated in the horizontal and vertical width directions.

As described above, the banknote handling apparatus 1 of the present embodiment, using the first front-back inverting unit 81 and the second front-back inverting unit 82, can perform front-back inversion of the banknotes S being conveyed by the coupled conveyance unit 70 based on the front-back identification information. Thereby, even when banknotes S are conveyed in a state in which the front-back directionality is mixed, the front-back directionality can be unified during conveyance.

In particular, since processing can be performed that unifies the banknotes S so that the front and back faces thereof are facing the same way simply by providing a front-back inverting unit 80 (first front-back inverting unit 81 and the second front-back inverting unit 82) equipped with the non-inverting unit 91 and the inverting unit 92 in the device case 60, the configuration can be simplified and the entire banknote handling apparatus 1 can be made smaller and more compact.

In particular, when the banknotes S have been conveyed to the first accumulation and storage unit 100 and the second accumulation and storage unit 101, the banknote handling apparatus 1 of the present embodiment, by rotating the first alignment unit 160 and the second alignment unit 200 from the first retracted position P1 and the second retracted position P2 to the first alignment position K1 and the second alignment position K2, respectively, can tap the banknotes S accumulated on the upper base unit 112 from both sides in the horizontal width direction, and align the banknotes S in the horizontal width direction.

In this way, by aligning the banknotes S by tapping from both sides in the horizontal width direction instead of aligning by tapping only from one side in the horizontal width direction as in the prior art, it is possible to reduce the moment stroke of the banknotes S (shift amount) and possible to efficiently perform reliable alignment. Therefore, the banknotes S can be quickly and reliably aligned, and the operation time required for the alignment process can be shortened.

Furthermore, by positioning the first alignment unit 160 and the second alignment unit 200 at the first retracted position P1 and the second retracted position P2, the first alignment unit 160 and the second alignment unit 200 can be spaced outward of the entrance area of the banknotes S through which the banknotes S pass until being accumulated on the upper base unit 112. Accordingly, it is possible to prevent the occurrence of a paper jam due to jamming of the banknotes S.

Furthermore, since the first alignment unit 160 and the second alignment unit 200 have the first planar contact unit 162 and the second planar contact unit 202 that make linear or surface contact with the banknotes S, compared to the case of using a conventional cylindrical abutting portion, it is more difficult to leave a strike mark on the banknotes S. Moreover, when the banknotes S are tapped from both sides by using the conventional cylindrical abutting portions, depending on the position of the strike, there is a risk that the banknotes S may be rotated, disrupting their alignment.

In contrast, in the present embodiment, since the first planar contact unit 162 and the second planar contact unit 202, which have wide and flat contact surfaces, are used it is possible to prevent the conventional rotation of the banknotes S that may occur and the accompanying disruption of the alignment of the banknotes S, and can stably align the banknotes S.

Moreover, when the banknotes S have been conveyed to the first accumulation and storage unit 100 and the second accumulation and storage unit 101, the banknote handling apparatus 1 of the present embodiment, by swinging the alignment plate 311 from the third retracted position P3 to the third alignment position K3, can tap the banknotes S accumulated on the upper base unit 112 from one side in the vertical width direction, and align the banknotes S in the vertical width direction with the fourth stopper unit 420. As a result, due to the synergistic effect of the alignment in the horizontal width direction by the first alignment unit 160 and the second alignment unit 200 described above, the banknotes S can be accurately aligned both in the horizontal width direction and in the vertical width direction, and the banknotes S can be stored in an accumulated state that is neatly aligned.

[Modification]

In the present embodiment, when the banknotes S have been aligned in the horizontal width direction in the first accumulation and storage unit 100 and the second accumulation and storage unit 101, the first alignment unit 160 and the second alignment unit 200 were nearly simultaneously rotated from the first retracted position P1 and the second retracted position P2 to the first alignment position K1 and the second alignment position K2, respectively, but the present invention is not limited to this case, and the first alignment unit 160 and the second alignment unit 200 may be rotated at different timings.

Figure 18:
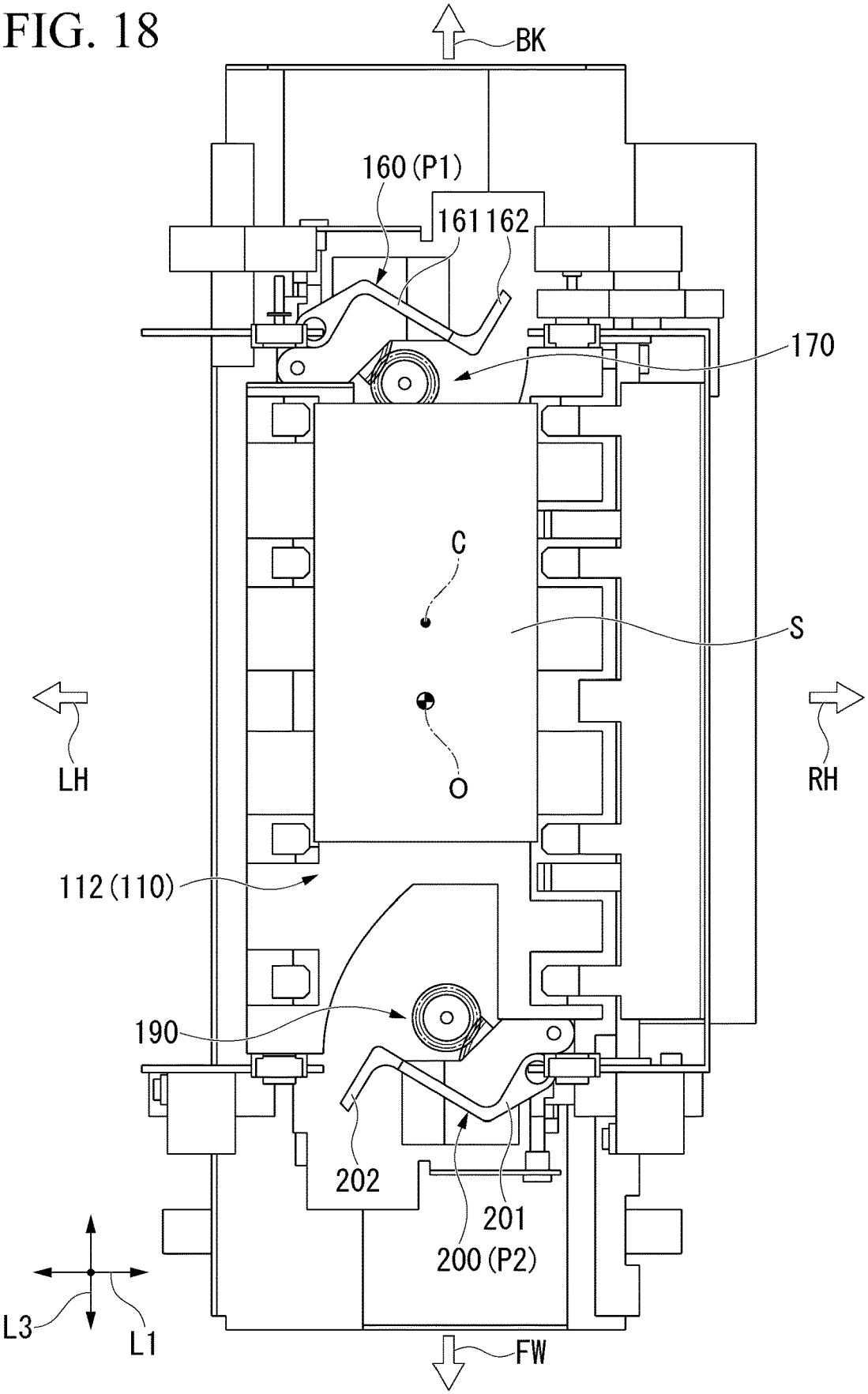
FIG. 18 is a plan view of the width-direction alignment unit when banknotes are accumulated on the upper base unit of the first accumulation and storage unit shown in FIG. 8, with the banknotes accumulated more toward the first alignment unit side.
Figure 19:
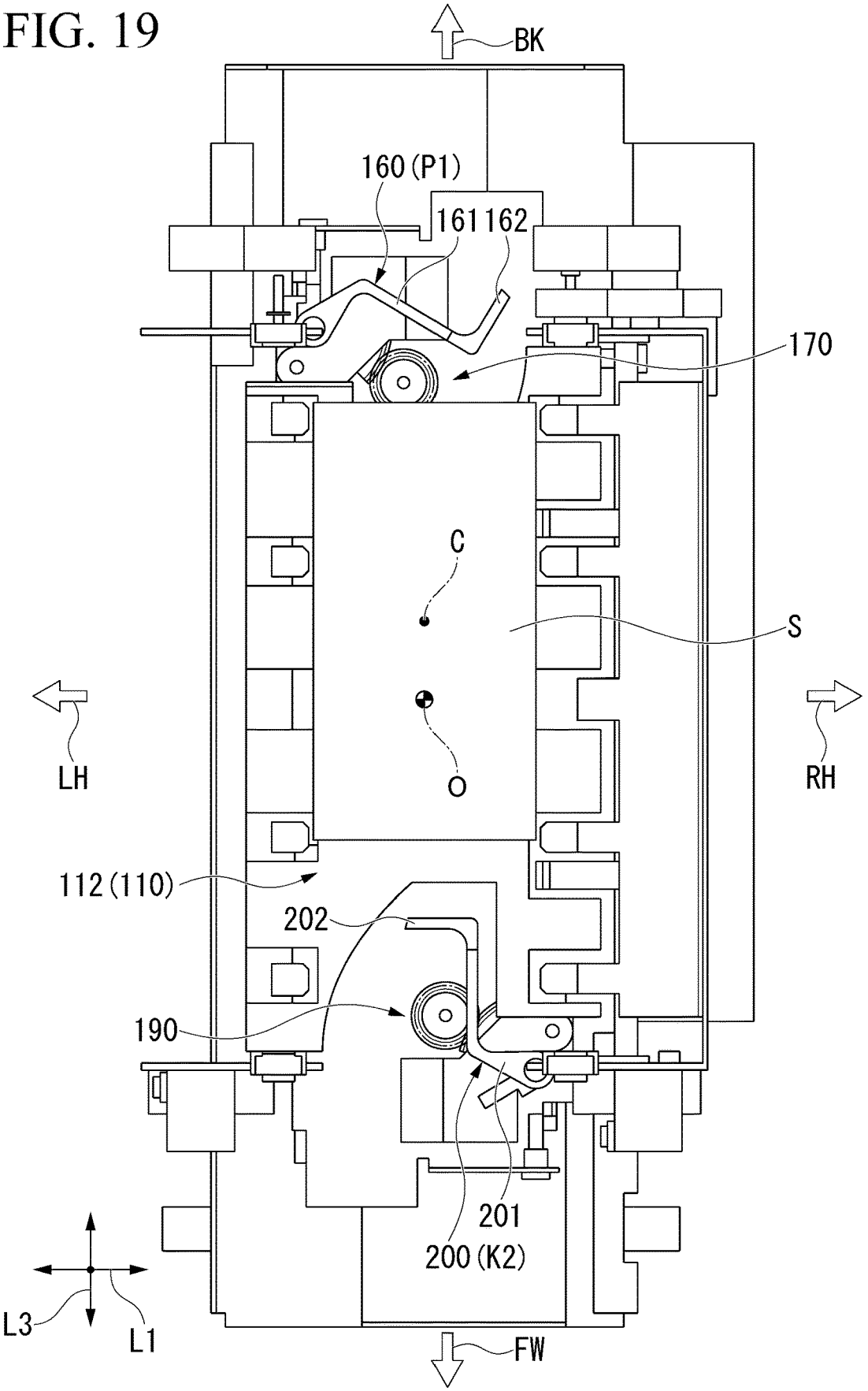
FIG. 19 is a plan view showing a state in which the second alignment unit of the width-direction alignment unit is advanced from the state shown in FIG. 18 to be positioned at the second alignment position.

For example, the control unit 51 obtains banknote conveyance position information indicating the position of the banknote S being conveyed with respect to the horizontal width direction from the identification unit 30, and, as shown in FIG. 18, if the center position C in the horizontal width direction of the banknotes S accumulated on the upper base unit 112 is closer to one side (to the first alignment unit 160 side) than the reference position O by the upper base unit 112, as shown in FIG. 18, the second alignment unit 200 is rotated first to the second alignment position K2. As a result, the second planar contact unit 202 can be kept on standby so as to be substantially parallel to the vertical width direction of the banknotes S, which is the conveying direction.

Figure 20:
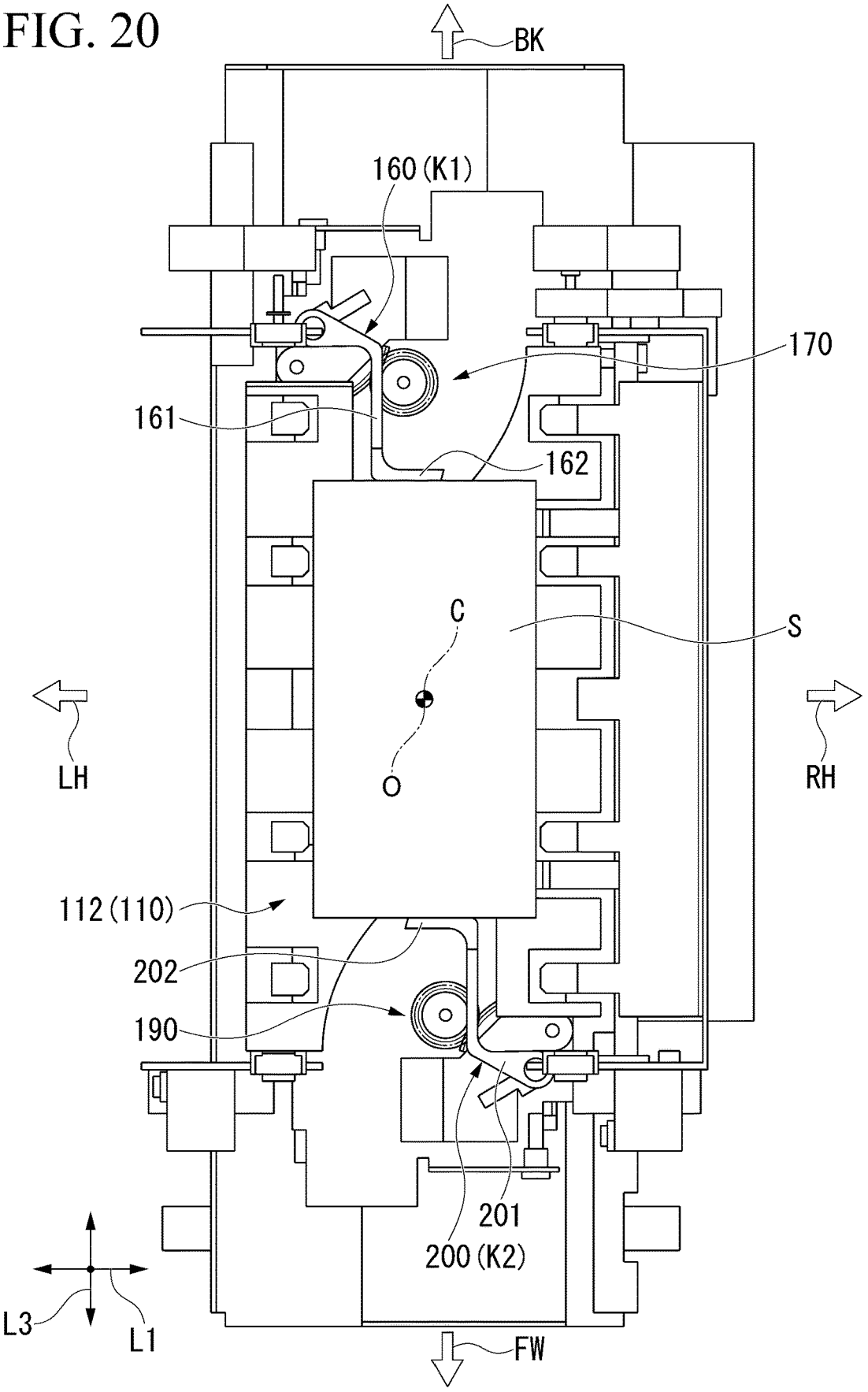
FIG. 20 is a plan view showing a state in which the horizontal width of banknotes are aligned by positioning the first alignment unit of the width-direction alignment unit to the first alignment position from the state shown in FIG. 19.

Subsequently, as shown in FIG. 20, the first alignment unit 160 is rotated to the first alignment position K1 to tap the banknotes S, pushing the banknotes S so as to abut against the second planar contact unit 202 of the second alignment unit 200, which is already standing by in the second alignment position K2. Thereby, the banknotes S accumulated on the upper base unit 112 can be aligned in the horizontal width direction.

Contrary to the case described above, when the center position C in the horizontal width direction of the banknotes S accumulated on the upper base unit 112 is shifted to the other side (the second alignment unit 200 side) of the reference position O by the upper base unit 112, the first alignment unit 160 is first rotated to the first alignment position K1. As a result, the first planar contact unit 162 can be kept on standby so as to be substantially parallel to the vertical width direction of the banknotes S, which is the conveying direction. Subsequently, the second alignment unit 200 is rotated to the second alignment position K2 to tap the banknotes S, drawing the banknotes S together so as to abut against the first planar contact unit 162 of the first alignment unit 160, which is already waiting at the first alignment position K1. Thereby, the banknotes S accumulated on the upper base unit 112 can be aligned in the horizontal width direction.

Therefore, even in the case described above, the banknotes S accumulated on the upper base unit 112 can be neatly aligned in the horizontal width direction.

Although embodiments of the present invention have been described above, these embodiments are presented as examples and are not intended to limit the scope of the invention. Embodiments can be implemented in various other forms, and various omissions, replacements, and modifications can be made without departing from the scope of the invention. Embodiments and modifications thereof include, for example, those that can be easily imagined by those skilled in the art, those that are substantially the same, and those within an equivalent range.

For example, in the above-described embodiment, the case in which the banknote handling apparatus 1 is equipped with the identification and counting device 2 and the accumulation and bundling device 3 that are coupled to each other was described as an example, but the identification and counting device 2 is not essential and does not have to be provided.

Furthermore, the configuration is not limited to the case where only one accumulation and bundling device 3 is provided, and two or more may be provided.

For example, the banknote handling apparatus 1 may be formed by coupling two accumulation and bundling devices 3 in the left-right direction L1. In this case, by connecting the coupled conveyance unit 70 in the second accumulation and bundling device 3 to the option outlet 71 of the coupled conveyance unit 70 in the first accumulation and bundling device 3, the banknotes S can be continuously conveyed from the first accumulation and bundling device 3 to the second accumulation and bundling device 3.

When the banknote handling apparatus 1 is configured in this way, for example, the soiled banknotes S identified as soiled banknotes S (soiled paper sheets) by the identification unit 30 can be passed through the first accumulation and bundling device 3, and small bundles of soiled banknotes S can be made in the second accumulation and bundling device 3, while unifying the front-back directionality thereof. Therefore, the second accumulation and bundling device 3 can be used as a dedicated device for bundling the damaged banknotes S.

This allows for uses such as making small bundles while separating the soiled banknotes S from the other banknotes S.

Furthermore, instead of soiled banknotes S, utilizing a second accumulation and bundling device 3 allows for uses such as making small bundles while unifying the front-back directionality of banknotes S of denominations different from those of the first accumulation and bundling device 3. For example, the first accumulation and bundling device 3 can be used for banknotes S of 10,000 yen as in the above embodiment, while the second accumulation and bundling device 3 can be used for banknotes S of 5,000 yen.

Furthermore, a total of four accumulation and bundling devices 3 can be coupled for use as a dedicated accumulation and bundling device 3 for banknotes S of 10,000-yen notes, 5,000-yen notes, 2,000-yen notes, and 1,000-yen notes.

Furthermore, the above embodiment is configured with the first front-back inverting unit 81 and the second front-back inverting unit 82, but the first front-back inverting unit 81 and the second front-back inverting unit 82 are not essential and do not have to be provided.

Even in this case, for example, by conveying the banknotes S with their front-back directionalities unified to the coupled conveyance unit 70, the first accumulation and storage unit 100 and the second accumulation and storage unit 101 can be used to store the banknotes S in an accumulated state while aligning them.

Furthermore, in the case where the first front-back inverting unit 81 and the second front-back inverting unit 82 are not provided, for example, the first accumulation and storage unit 100 and the second accumulation and storage unit 101 may be arranged side by side in the vertical direction L2.

Figure 21:
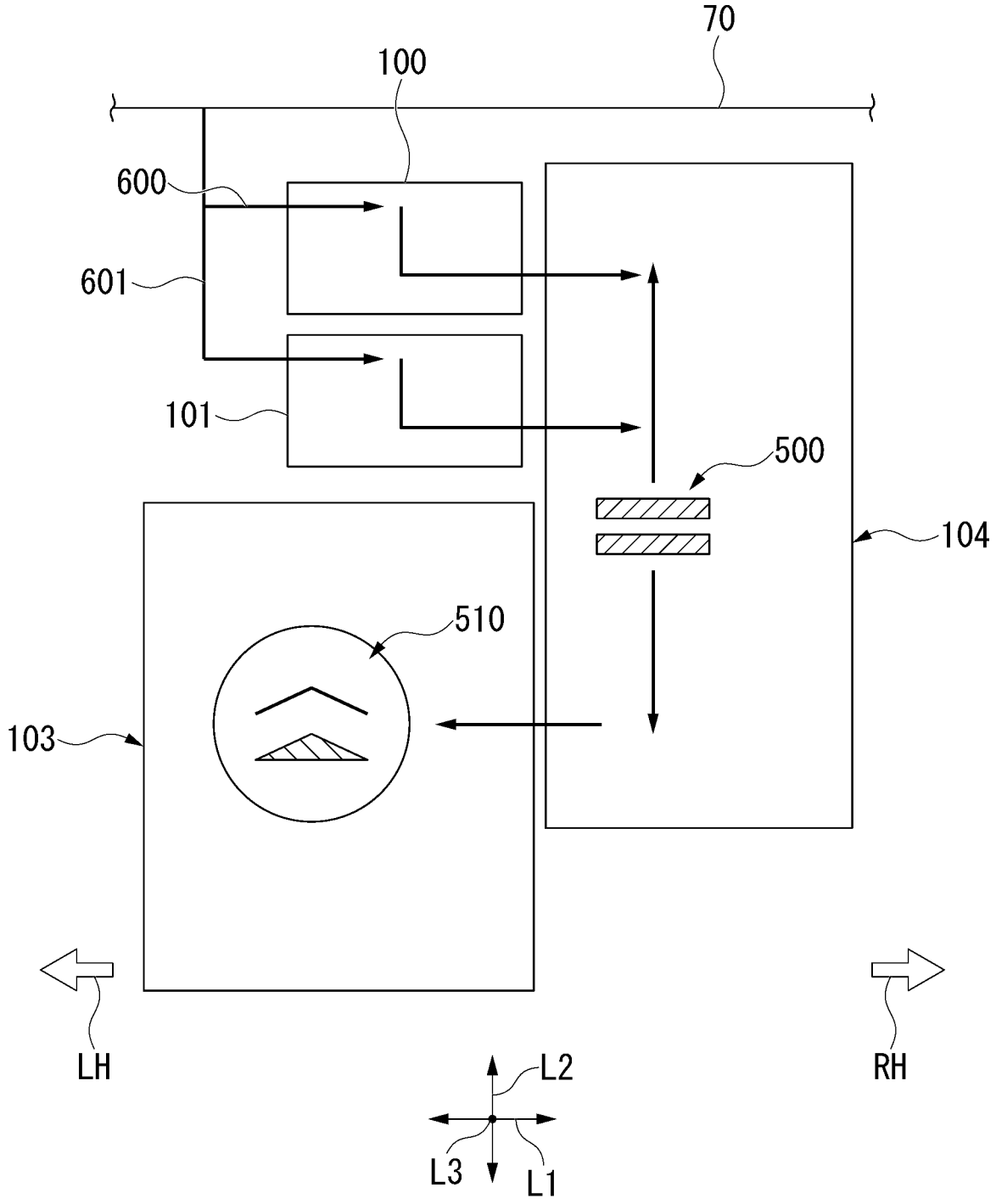
FIG. 21 is a schematic diagram showing a banknote handling apparatus, which is a modification of the banknote handling apparatus of the present embodiment, in which a first accumulation and storage unit and a second accumulation and storage unit are vertically arranged side by side.

Specifically, as shown in FIG. 21, the second accumulation and storage unit 101 may be arranged below the first accumulation and storage unit 100. In this case, a branch conveyance unit 600 branched from the coupled conveyance unit 70 may be connected to the first accumulation and storage unit 100, and a second branch conveyance unit 601 further branched from the first branch conveyance unit 600 may be connected to the second accumulation and storage unit 101. Further, the bundling unit 103 can be arranged below the first accumulation and storage unit 100 and the second accumulation and storage unit 101, and the accumulation conveyance unit 104 can be arranged so as to move in the vertical direction L2 between the first accumulation and storage unit 100, the second accumulation and storage unit 101, and the bundling unit 103.

Even in this configuration, it is possible to create small bundles by bundling with the bundling unit 103 banknotes S in an aligned and accumulated state in the first accumulation and storage unit 100 and banknotes S in an aligned and accumulated state in the second accumulation and storage unit 101.

Furthermore, in the above-described embodiment, Japanese banknotes S are used as an example of paper sheets, but as described above, foreign banknotes S may be used, and the embodiment is not limited to banknotes S. For example, the present invention can be applied to a device that processes paper sheets in general, such as gift certificates, checks, money market instruments such as commercial paper, and securities.

In particular, according to the first accumulation and storage unit 100 and the second accumulation and storage unit 101 of the present embodiment, since according to the size of the paper sheets the spacing between the first base unit 140 and the second base unit 180 can be adjusted, and the spacing between the third base unit 250 and the fourth base unit 400 can be adjusted, it is possible to accommodate a variety of paper sheets, thereby enabling an enhancement of convenience and ease of use.

Furthermore, in the above-described embodiment, when setting the banknotes S in the loading unit 11, they are set in an orientation aligning the long sides of the banknotes S, that is, the horizontal width direction, with the front-rear direction L3 of the apparatus, and aligning the short sides of the banknotes S, that is, the vertical width direction, with the left-right direction L1 of the apparatus, but the embodiment is not limited to this case, and the apparatus may be constituted so that the banknotes S are set in an orientation aligning the long sides of the banknotes S, that is, the horizontal width direction, with the left-right direction L3 of the apparatus, and aligning the short sides of the banknotes S, that is, the vertical width direction, with the front-rear direction L3.

Furthermore, in the above embodiment, although the description was given by taking the example of the configuration that applies the first alignment unit 160 and the second alignment unit 200 to the width-direction alignment unit 120 in the first accumulation and storage unit 100 and the second accumulation and storage unit 101 to align the banknotes in the horizontal width direction, the invention is not limited to this case. That is, the first alignment unit 160 and the second alignment unit 200 may be applied to the conveyance direction alignment unit 130 to align the banknotes S in the vertical width direction. In other words, the first alignment unit and the second alignment unit according to the present invention can be used in either case of aligning the banknotes S in the horizontal width direction or in the case of aligning the banknotes S in the vertical width direction.

INDUSTRIAL APPLICABILITY

The present invention can be applied to a paper sheet handling apparatus for handling paper sheets such as banknotes, and can provide a paper sheet handling apparatus capable of quickly and reliably aligning paper sheets.

REFERENCE SIGNS LIST

C Center position
O Reference position
S Banknote (paper sheet)
K1 First alignment position
K2 Second alignment position
K3 Third alignment position
P1 First retracted position
P2 Second retracted position
P3 Third retracted position
1 Banknote handling apparatus (paper sheet handling apparatus)
2 Identification and counting device
11 Loading unit
20 Identification and conveyance unit
30 Identification unit
40 Outbound conveyance unit
51 Control unit
70 Coupled conveyance unit (conveyance unit)
100 First accumulation and storage unit (accumulation and storage unit)
101 Second accumulation and storage unit (accumulation and storage unit)
104 Accumulation conveyance unit
110 Unit base unit (accumulation unit)
140 First base unit

160 First alignment unit
162 First planar contact unit
180 Second base unit
200 Second alignment unit
202 Second planar contact unit
250 Third base unit
280 Third conveyance unit (Third accumulation conveyance unit)
282 Third conveyance roller
311 Alignment plate
380 Alignment plate drive unit
400 Fourth base unit
430 Fourth conveyance unit (Fourth accumulation conveyance unit)
432 Fourth conveyance roller

The invention claimed is:

1. A paper sheet handling apparatus comprising:

a conveyance unit that conveys paper sheets;

an accumulation and storage unit that accumulates and stores paper sheets conveyed by the conveyance unit while aligning the paper sheets; and a control unit that controls the accumulation and storage unit, wherein the accumulation and storage unit comprises:

an accumulation unit that accumulates paper sheets so that a first direction, which is one direction of the vertical width direction and the horizontal width direction, and a second direction, which is the other of the vertical width direction and the horizontal width direction, are oriented in predetermined directions;

a first alignment unit that is arranged more to one side in the first direction than the accumulation unit and constituted to be movable between a first retracted position spaced apart from the paper sheets accumulated in the accumulation unit, and a first alignment position that is in contact with one end edge positioned in the first direction of the paper sheets accumulated in the accumulation unit; and a second alignment unit that is arranged more to the other side in the first direction than the accumulation unit and constituted to be movable between a second retracted position spaced apart from the paper sheets accumulated in the accumulation unit, and a second alignment position that is in contact with the other end edge positioned in the first direction of the paper sheets accumulated in the accumulation unit, a third base unit disposed more to one side in the second direction than the accumulation unit and configured to be movable along the second direction;

a fourth base unit disposed more to the other side in the second direction than the accumulation unit, configured to be movable along the second direction, and configured to be capable of approaching and separating from the third base unit;

a third accumulation conveyance unit mounted on the third base unit and having a third conveyance roller for loading the paper sheets conveyed from the conveyance unit into the accumulation unit; and a fourth accumulation conveyance unit mounted on the fourth base unit and having a fourth conveyance roller for loading the paper sheets conveyed from the conveyance unit into the accumulation unit, wherein the control unit causes the paper sheets to be aligned in the first direction by causing the first alignment unit and the second alignment unit to move from the first retracted position and the second retracted position to the first alignment position and the second alignment position and tap the paper sheets accumulated in the accumulation unit from both sides in the first direction, and further causes the third base unit and the fourth base unit to move along the second direction according to the type of paper sheets accumulated in the accumulation unit, to adjust the spacing between the third base unit and the fourth base unit.

2. The paper sheet handling apparatus according to claim 1, wherein the accumulation and storage unit further comprises:

a first base unit disposed more to one side in the first direction than the accumulation unit and configured to be movable along the first direction; and a second base unit disposed more to the other side in the first direction than the accumulation unit, provided to be movable along the first direction, and configured to be capable of approaching and separating from the first base unit, wherein the first alignment unit is mounted on the first base unit, the second alignment unit is mounted on the second base unit, and the control unit causes the first base unit and the second base unit to move along the first direction according to the type of paper sheets accumulated in the accumulation unit, to adjust the spacing between the first alignment unit and the second alignment unit.

3. The paper sheet handling apparatus according to claim 2, wherein the first alignment unit has a first planar contact unit that is arranged along the second direction of the paper sheets and contacts the one end edge of the paper sheets when positioned at the first alignment position, the second alignment unit has a second planar contact unit that is arranged along the second direction of the paper sheets and contacts the other end edge of the paper sheets when positioned at the second alignment position, and the control unit causes the first base unit and the second base unit to move along the first direction so that, when the first alignment unit and the second alignment unit are positioned at the first alignment position and the second alignment position, the spacing in the first direction between the first planar contact unit and the second planar contact unit matches the length in the first direction of the paper sheets accumulated in the accumulation unit.

4. The paper sheet handling apparatus according to claim 1, wherein the control unit causes the first alignment unit and the second alignment unit to move simultaneously from the first retracted position and the second retracted position to be positioned at the first alignment position and the second alignment position.

5. The paper sheet handling apparatus according to claim 1, wherein, when the paper sheets accumulated in the accumulation unit are accumulated in a state of the center position of the paper sheets in the first direction being shifted closer to the first alignment unit than a reference position located at substantially a center of the first direction and the second direction of the accumulation unit of the accumulation unit, the control unit aligns the paper sheets by, after first causing the second alignment unit to move to the second alignment position, causing the first alignment unit to tap the paper sheets by moving to the first alignment position, thereby causing the paper sheets to abut the second alignment unit standing by at the second alignment position, and wherein, when the paper sheets accumulated in the accumulation unit are accumulated in a state of the center position being shifted closer to the second alignment unit than the reference position, the control unit aligns the paper sheets by, after first causing the first alignment unit to move to the first alignment position, causing the second alignment unit to tap the paper sheets by moving to the second alignment position, thereby causing the paper sheets to abut the first alignment unit standing by at the first alignment position.

6. The paper sheet handling apparatus according to claim 1, further comprising:

an alignment plate that is mounted on the third base unit and is configured to be movable between a third retracted position separated from the paper sheets accumulated in the accumulation unit, and a third alignment position that is in contact with one end edge positioned in the second direction of the paper sheets accumulated in the accumulation unit; and an alignment plate drive unit that moves the alignment plate from the third retracted position to the third alignment position in conjunction with the third conveyance roller, wherein the control unit aligns the paper sheets accumulated in the accumulation unit in the second direction by driving the alignment plate drive unit in accordance with the type of paper sheets accumulated in the accumulation unit to move the alignment plate from the third retracted position to the third alignment position.

* * * * *